US010854163B2

(12) United States Patent
Nishimura et al.

(10) Patent No.: US 10,854,163 B2
(45) Date of Patent: Dec. 1, 2020

(54) DISPLAY DEVICE SUPPRESSING DISPLAY FAILURE CAUSED BY RESIDUAL CHARGE

(71) Applicant: Sharp Kabushiki Kaisha, Sakai (JP)

(72) Inventors: Jun Nishimura, Sakai (JP); Takuya Watanabe, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/592,808

(22) Filed: Oct. 4, 2019

(65) Prior Publication Data

US 2020/0135136 A1 Apr. 30, 2020

Related U.S. Application Data

(60) Provisional application No. 62/752,391, filed on Oct. 30, 2018.

(51) Int. Cl.
*G09G 3/36* (2006.01)

(52) U.S. Cl.
CPC ..... *G09G 3/3696* (2013.01); *G09G 3/3677* (2013.01)

(58) Field of Classification Search
CPC ..... G09G 3/36; G09G 3/3611; G09G 3/3625; G09G 3/3674; G09G 3/3677; G09G 3/3681; G09G 3/3685; G09G 3/3688; G09G 3/3696
USPC ..... 345/87–104
See application file for complete search history.

(56) References Cited

U.S. PATENT DOCUMENTS

| | | | | |
|---|---|---|---|---|
| 9,293,094 | B2 * | 3/2016 | Morii | G09G 3/3611 |
| 10,629,630 | B2 * | 4/2020 | Yoshida | G09G 3/36 |
| 2010/0182305 | A1 * | 7/2010 | Fang | G09G 3/3677 345/212 |
| 2010/0309173 | A1 * | 12/2010 | Matsuda | G09G 3/3674 345/204 |
| 2011/0134090 | A1 * | 6/2011 | Iwamoto | G09G 3/3677 345/206 |
| 2012/0218245 | A1 * | 8/2012 | Morii | G09G 3/3677 345/211 |
| 2014/0191935 | A1 | 7/2014 | Morii et al. | |
| 2014/0306948 | A1 * | 10/2014 | Iwamoto | G09G 3/3677 345/213 |
| 2015/0269900 | A1 | 9/2015 | Iwamoto et al. | |
| 2015/0332632 | A1 * | 11/2015 | Nakata | G06K 9/0051 345/690 |

(Continued)

FOREIGN PATENT DOCUMENTS

| | | | |
|---|---|---|---|
| WO | 2013/021930 | A1 | 2/2013 |
| WO | 2014/061574 | A1 | 4/2014 |

*Primary Examiner* — Alexander Eisen
*Assistant Examiner* — Nelson Lam
(74) *Attorney, Agent, or Firm* — Keating & Bennett, LLP

(57) ABSTRACT

When supply of power has stopped, voltages of GDM signals are set as follows. A clear signal that contributes to removal of charge at floating nodes (an output control node and a stabilization node) in each unit circuit included in a shift register is set to a voltage of ground, and other signals (a gate start pulse signal, gate clock signals, and a reference voltage) are set to a gate-on voltage. To implement such settings, a single power supply system configuration that uses a voltage of only one channel as a scanning line selection voltage is adopted.

10 Claims, 19 Drawing Sheets

(56) References Cited

U.S. PATENT DOCUMENTS

| | | | | |
|---|---|---|---|---|
| 2016/0042806 | A1* | 2/2016 | Ogawa | G11C 19/28<br>345/205 |
| 2019/0172843 | A1* | 6/2019 | Yoshida | G09G 3/20 |

* cited by examiner

DISPLAY DEVICE SUPPRESSING DISPLAY FAILURE CAUSED BY RESIDUAL CHARGE

CROSS REFERENCE TO RELATED APPLICATIONS

This application claims priority to U.S. Provisional Patent Application No. 62/752,391, entitled "DISPLAY DEVICE", filed on Oct. 30, 2018, the content of which is incorporated herein by reference.

BACKGROUND OF THE INVENTION

1. Field of the Invention

The following disclosure relates to a display device, and more particularly to a process performed when supply of power from an external source has stopped, and a configuration for the process.

2. Description of Related Art

In general, an active matrix-type liquid crystal display device includes a liquid crystal layer and a liquid crystal panel including two substrates that sandwich the liquid crystal layer therebetween. On one of the two substrates, there are provided a plurality of scanning lines, a plurality of data lines, and a plurality of pixel formation portions arranged in a matrix form at intersections of the plurality of scanning lines and the plurality of data lines. Each pixel formation portion includes a thin-film transistor (TFT) connected at its gate terminal to a scanning line passing through a corresponding intersection, and connected at its source terminal to a data line passing through the intersection; a pixel capacitance for writing a data signal transmitted by the data line; and the like. In addition, a common electrode which is common to the plurality of pixel formation portions is typically provided on the other one of the two substrates. The active matrix-type liquid crystal display device further includes a gate driver (scanning line drive circuit) that drives the plurality of scanning lines, and a source driver (data line drive circuit) that drives the plurality of data lines.

As described above, data signals are transmitted by the data lines, but each data line cannot transmit data signals for a plurality of rows at one time (simultaneously). Due to this, writing of data signals to the pixel capacitances in the pixel formation portions is sequentially performed row by row, for example. Hence, in order to sequentially select the plurality of scanning lines for a predetermined period, the gate driver is composed of a shift register including a plurality of stages.

Conventionally, the gate driver is often mounted, as an integrated circuit (IC) chip, in a portion around a substrate that constitutes the liquid crystal panel, but in recent years, forming the gate driver directly on the substrate has gradually increased. Such a gate driver is called a "monolithic gate driver".

In addition, in recent years, development of a liquid crystal panel that uses TFTs having a channel layer formed of indium gallium zinc oxide which is an oxide semiconductor whose main components are indium (In), gallium (Ga), zinc (Zn), and oxygen (O) (hereinafter, referred to as "IGZO-TFTs") has been proceeding. The liquid crystal panel using IGZO-TFTs is hereinafter referred to as IGZO-TFT liquid crystal panel. Regarding the IGZO-TFT liquid crystal panel, too, development of a monolithically formed gate driver has been proceeding. A monolithic gate driver provided in the IGZO-TFT liquid crystal panel is hereinafter referred to as "IGZO-GDM". In addition, control signals provided to the monolithic gate driver are hereinafter referred to as "GDM signals".

Meanwhile, a Vg-Id characteristic of the IGZO-TFT is represented by a thick line given reference character 91 in FIG. 26. It can be grasped from a dashed-line portion given reference character 911 in FIG. 26 that the IGZO-TFT has a remarkably small off-leakage current. That is, the IGZO-TFT is excellent in off characteristics. Hence, by performing low-frequency driving by adopting IGZO-TFTs, it becomes possible to reduce power consumption. However, when the off characteristics are excellent, residual charge is likely to occur in the panel upon power-off. Accumulation of residual charge causes burn-in. In addition, when the power of the device is turned on with residual charge accumulated, flicker caused by unbalanced impurities based on the residual charge occurs, degrading display quality. Due to the above, regarding the IGZO-TFT liquid crystal panel, it is a conventional problem to suppress the occurrence of display failure caused by residual charge.

In view of this, International Publication No. 2014/061574 pamphlet discloses a technique in which charge is prevented from remaining in the panel in a case where an IGZO-TFT liquid crystal panel is adopted. In order to prevent charge from remaining in the panel, there are required a process of discharging charge in the pixel formation portions, a process of discharging charge on the scanning lines, and a process of discharging charge in the gate driver. In order to implement this, a liquid crystal display device disclosed in International Publication No. 2014/061574 pamphlet adopts a configuration (hereinafter, referred to as "two power supply system configuration" for convenience sake) in which voltages of two channels are used as a voltage with a level that brings the scanning lines into a selected state (hereinafter, referred to as "scanning line selection voltage"). That is, as the scanning line selection voltage, two types of voltages VGH1 and VGH2, such as those shown in FIG. 27, having different level change rates (level decrease rates) upon power-off are used. Note that a configuration using a voltage of only one channel as the scanning line selection voltage is hereinafter referred to as "single power supply system configuration", a power supply that generates a voltage whose level changes in a slope manner as shown in FIG. 27 upon power-off is hereinafter referred to as "slope power supply", and a series of processes performed when supply of power from an external source has stopped is hereinafter referred to as "off sequence".

International Publication No. 2013/021930 pamphlet also discloses a technique in which charge is prevented from remaining in the panel in a case where an IGZO-TFT liquid crystal panel is adopted.

According to the conventional configurations, an off sequence that removes residual charge in the panel requires two slope power supplies. Regarding this, since the off sequence is processes performed after the stop of supply of power, a capacitor is charged in advance in the device, and the charge accumulated in the capacitor is discharged, by which slope power supplies are implemented. The two power supply system configuration requires a larger number of circuit elements than the single power supply system configuration, resulting in high cost. In addition, one of the voltages of two channels needs to change its level in a very gentle slope manner, and the amount of charging required is increased to the extent that designing a power supply system becomes difficult.

SUMMARY OF THE INVENTION

Hence, it is desired for a display device adopting TFTs with excellent off characteristics to suppress the occurrence of display failure caused by residual charge, with a simple configuration.

(1) Display devices according to several embodiments of the present invention are each a display device including:

a display panel including a plurality of scanning lines each connected to a plurality of pixel formation portions, and a scanning line drive circuit configured to selectively drive the plurality of scanning lines;

a voltage generator circuit configured to receive supply of power from an external source, and generate one type of scanning line selection voltage and one type of scanning line non-selection voltage, the scanning line selection voltage being a voltage for bringing the scanning lines into a selected state, and the scanning line non-selection voltage being a voltage for bringing the scanning lines into a non-selected state; and a drive control circuit configured to control operation of the scanning line drive circuit, using the scanning line selection voltage and the scanning line non-selection voltage generated by the voltage generator circuit, wherein the scanning line drive circuit includes a shift register configured to perform shift operation based on a plurality of clock signals, the shift register including a plurality of unit circuits provided so as to have one-to-one correspondence with the plurality of scanning lines, each unit circuit includes:

an output node connected to a corresponding scanning line;

an output control transistor having a control terminal, a first conduction terminal to which one of the plurality of clock signals is provided, and a second conduction terminal connected to the output node;

an output control node connected to the control terminal of the output control transistor; and a reset transistor having a control terminal to which a clear signal for initializing internal states of the plurality of unit circuits is provided; a first conduction terminal connected to the output control node; and a second conduction terminal to which a reference voltage is provided, the reference voltage being outputted from the drive control circuit and serving as a reference for operation of the scanning line drive circuit, and the drive control circuit:

sets a voltage of each of the plurality of clock signals to the scanning line selection voltage and the scanning line non-selection voltage alternately and sets the reference voltage to the scanning line non-selection voltage, at normal times; and sets the voltage of each of the plurality of clock signals and the reference voltage to the scanning line selection voltage and sets a voltage of the clear signal to less than or equal to a voltage of ground, when the supply of power stops.

According to such a configuration, when supply of power has stopped, GDM signals other than the clear signal are set to the scanning line selection voltage, by which each scanning line goes into a selected state and charge in each pixel formation portion is discharged. Thereafter, by a decrease in the level of the scanning line selection voltage, charge on the scanning line is also discharged. Here, there is almost no influence on display by residual charge at the output control node in each unit circuit. In addition, since a voltage required as the scanning line selection voltage when supply of power has stopped is of only one type, it is possible to adopt a voltage generator circuit that generates one type of scanning line selection voltage and one type of scanning line non-selection voltage. Since it is possible to adopt a single power supply system configuration in this manner, the number of circuit elements required is reduced. By the above, it becomes possible for a liquid crystal display device that adopts thin-film transistors with excellent off characteristics to suppress the occurrence of display failure caused by residual charge, with a simple configuration.

(2) Moreover, display devices according to several embodiments of the present invention are each a display device including the configuration of above (1), wherein the drive control circuit sets the voltage of the clear signal to the voltage of the ground when the supply of power stops.

(3) Moreover, display devices according to several embodiments of the present invention are each a display device including the configuration of above (1), wherein each unit circuit includes an off control transistor having a control terminal, a first conduction terminal, and a second conduction terminal connected to the output control node, and the drive control circuit:

sets a voltage provided to the control terminal of the off control transistor and a voltage provided to the first conduction terminal of the off control transistor to the scanning line non-selection voltage at normal times; and sets the voltage provided to the control terminal of the off control transistor and the voltage provided to the first conduction terminal of the off control transistor to the scanning line selection voltage when the supply of power stops.

(4) Moreover, display devices according to several embodiments of the present invention are each a display device including the configuration of above (3), wherein an off control signal outputted from the drive control circuit is provided to the control terminal of the off control transistor through a dedicated wiring line.

(5) Moreover, display devices according to several embodiments of the present invention are each a display device including the configuration of above (4), wherein the off control signal is provided to the first conduction terminal of the off control transistor.

(6) Moreover, display devices according to several embodiments of the present invention are each a display device including the configuration of above (4), wherein the reference voltage is provided to the first conduction terminal of the off control transistor.

(7) Moreover, display devices according to several embodiments of the present invention are each a display device including the configuration of above (1), wherein the display panel includes a plurality of transistors including the output control transistor and the reset transistor, and at least some of the plurality of transistors are transistors whose off-leakage current is 1/10 or less than off-leakage current of a thin-film transistor whose channel layer is formed of low-temperature polysilicon.

(8) Moreover, display devices according to several embodiments of the present invention are each a display device including the configuration of above (7), wherein at least some of the plurality of transistors are thin-film transistors whose channel layers are formed of indium gallium zinc oxide.

These and other objects, features, aspects, and effects of the present invention will be made more clear from the following detailed description of the present invention with reference to the accompanying drawings.

DETAILED DESCRIPTION OF PREFERRED EMBODIMENTS

Embodiments of the present invention will be described below with reference to the accompanying drawings. Note that each transistor is a field-effect transistor, and more specifically, an n-channel TFT. In the following description regarding the n-channel TFT, a gate terminal corresponds to a control terminal, a drain terminal corresponds to a first conduction terminal, and a source terminal corresponds to a second conduction terminal. Regarding this, for the n-channel TFT, one of the drain and source that has a higher potential is called a drain, but in the description of this specification, one is defined as a drain and the other as a source, and thus, a source potential may be higher than a drain potential.

1. First Embodiment

<1.1 Overall Configuration>

Figure 2:
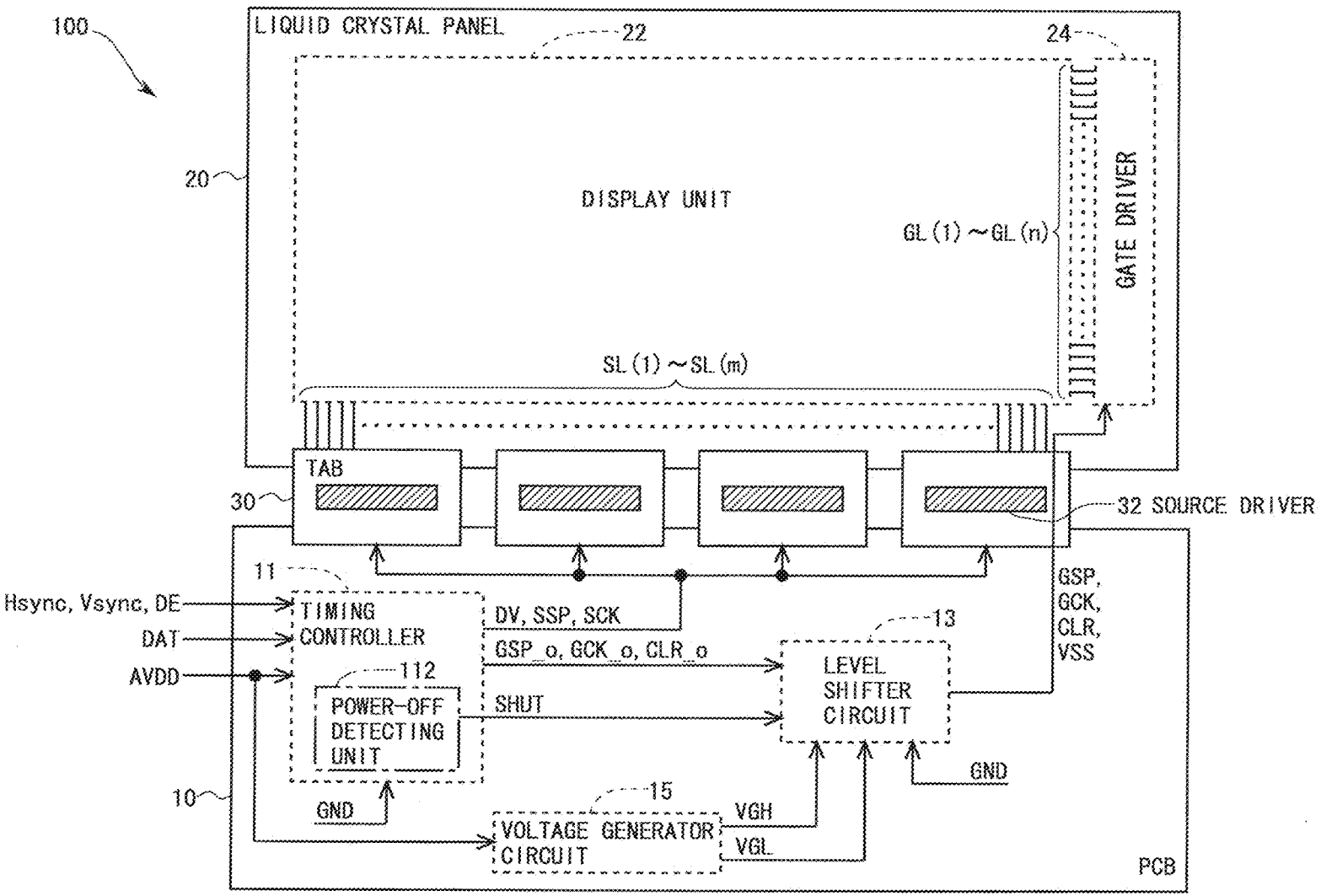
FIG. 2 is a block diagram showing an overall configuration of an active matrix-type liquid crystal display device in the first embodiment.

FIG. 2 is a block diagram showing an overall configuration of an active matrix-type liquid crystal display device 100 in a first embodiment. The liquid crystal display device 100 includes a printed circuit board (PCB) 10, a liquid crystal panel 20 serving as a display panel, and Tape Automated Bondings (TABs) 30 connected to the PCB 10 and the liquid crystal panel 20. A timing controller 11, a level shifter circuit 13, and a voltage generator circuit 15 are provided on the PCB 10. The liquid crystal panel 20 is an IGZO-TFT liquid crystal panel. Source drivers 32 for driving data lines SL(1) to SL(m) are mounted in the form of IC chips on the TABs 30.

The liquid crystal display device 100 operates by receiving supply of power (analog power) from an external source. A voltage inputted to the liquid crystal display device 100 based on the supply of power is hereinafter referred to as "input power supply voltage". The input power supply voltage is given reference character AVDD. The input power supply voltage AVDD at normal operation is, for example, +5 V. When the supply of power has stopped, the input power supply voltage AVDD gradually decreases, for example, from +5 V to 0 V (the voltage of ground GND).

The liquid crystal panel 20 includes a liquid crystal layer and two substrates (typically, glass substrates) that sandwich the liquid crystal layer therebetween. A display unit 22 for displaying an image is formed in a predetermined region on a substrate. The display unit 22 includes n scanning lines GL(1) to GL(n), m data lines SL(1) to SL(m), and m×n pixel formation portions arranged in a matrix form at intersections of the n scanning lines GL(1) to GL(n) and the m data lines SL(1) to SL(m). Note that m and n are integers greater than or equal to two.

Figure 3:
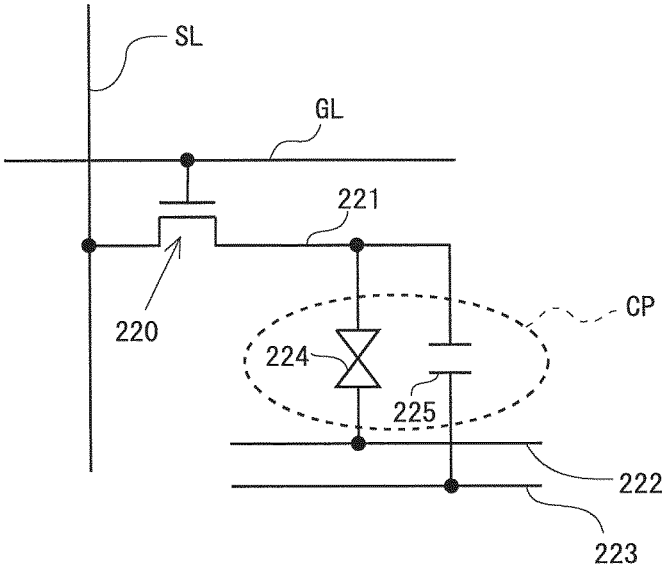
FIG. 3 is a circuit diagram showing a configuration of a pixel formation portion in the first embodiment.

FIG. 3 is a circuit diagram showing a configuration of a pixel formation portion. Each pixel formation portion includes a thin-film transistor 220 connected at its gate terminal to a scanning line GL passing through a corresponding intersection, and connected at its source terminal to a data line SL passing through the intersection; a pixel electrode 221 connected to a drain terminal of the thin-film transistor 220; a common electrode 222 and an auxiliary capacitance electrode 223 which are provided to the m×n pixel formation portions in a shared manner; a liquid crystal capacitance 224 formed by the pixel electrode 221 and the common electrode 222; and an auxiliary capacitance 225 formed by the pixel electrode 221 and the auxiliary capacitance electrode 223. A pixel capacitance CP is formed by the liquid crystal capacitance 224 and the auxiliary capacitance 225. When the scanning line GL connected to the gate terminal of the thin-film transistor 220 goes into a selected state, the thin-film transistor 220 goes into an on state, and a data signal transmitted by the data line SL is written into the pixel capacitance CP.

Note that in the present embodiment the thin-film transistor 220 is an IGZO-TFT. Note, however, that the thin-film transistor 220 is not limited thereto, and oxide TFTs other than the IGZO-TFT may be used as the thin-film transistor 220. Regarding this, in a case in which a transistor whose off-leakage current is 1/10 or less than that of a thin-film transistor whose channel layer is formed of low-temperature polysilicon is adopted, effects of the present invention are notably obtained.

In the liquid crystal panel 20, as shown in FIG. 2, there is further formed a gate driver (scanning line drive circuit) 24 for driving the scanning lines GL(1) to GL(n). The gate driver 24 is an IGZO-GDM, and is monolithically formed on a substrate that constitutes the liquid crystal panel 20. Note that although the gate driver 24 is disposed on only one side of the display unit 22 in FIG. 2, the gate drivers 24 may be disposed on both the left and right sides of the display unit 22.

As described above, in the present embodiment, the m data lines SL(1) to SL(m), the n scanning lines GL(1) to GL(n), the m×n pixel formation portions, and the gate driver 24 are formed on one substrate that constitutes the liquid crystal panel 20.

To the liquid crystal display device 100, timing signals such as a horizontal synchronizing signal Hsync, a vertical synchronizing signal Vsync, and a data enable signal DE, an image signal DAT, and an input power supply voltage AVDD are provided from external sources. The input power supply voltage AVDD is provided to the timing controller 11 and the voltage generator circuit 15.

The voltage generator circuit 15 generates, based on the input power supply voltage AVDD, a gate-on voltage VGH which is a voltage that brings the scanning lines GL into a selected state at normal operation, and a gate-off voltage VGL which is a voltage that brings the scanning lines GL into a non-selected state at normal operation. Regarding each of the gate-on voltage VGH and the gate-off voltage VGL which are generated by the voltage generator circuit 15, although the level is kept constant at normal operation, the level changes when supply of power has stopped. Note that at normal operation the gate-on voltage VGH is set to, for example, +20 V and the gate-off voltage VGL is set to, for example, −10 V. The gate-on voltage VGH and the gate-off voltage VGL which are generated by the voltage generator circuit 15 are provided to the level shifter circuit 13. As described above, regarding a voltage that brings the scanning lines GL into a selected state, a single power supply system configuration is adopted.

The timing controller 11 receives the timing signals such as the horizontal synchronization signal Hsync, the vertical synchronization signal Vsync, and the data enable signal DE, the image signal DAT, and the input power supply voltage AVDD, and generates digital video signals DV, a source start pulse signal SSP, a source clock signal SCK, a gate start pulse signal GSP_o, gate clock signals GCK_o, and a clear signal CLR_o. The digital video signals DV, the source start pulse signal SSP, and the source clock signal SCK are provided to the source driver 32, and the gate start pulse signal GSP_o, the gate clock signals GCK_o, and the clear signal CLR_o are provided to the level shifter circuit 13. Note that a high-level side voltage of the gate start pulse signal GSP_o, the gate clock signals GCK_o, and the clear signal CLR_o is set to the input power supply voltage AVDD, and a low-level side voltage of those signals is set to the voltage of the ground GND.

The timing controller 11 includes a power-off detecting unit 112. The power-off detecting unit 112 generates a power supply state signal SHUT indicating the state of supply of power from the external source (the power on/off state), and provides the power supply state signal SHUT to the level shifter circuit 13.

The level shifter circuit 13 converts the voltage levels of the gate start pulse signal GSP_o, the gate clock signals GCK_o, and the clear signal CLR_o which are outputted from the timing controller 11, using the gate-on voltage VGH and the gate-off voltage VGL which are provided from the voltage generator circuit 15. A gate start pulse signal GSP, gate clock signals GCK, and a clear signal CLR obtained after converting the voltage levels by the level shifter circuit 13 are provided to the gate driver 24. In addition, the level shifter circuit 13 generates a reference voltage VSS that is a voltage as a reference for the operation of the gate driver 24, based on an internal signal. The reference voltage VSS is provided to the gate driver 24.

The source drivers 32 receive the digital video signals DV, the source start pulse signal SSP, and the source clock signal SCK which are outputted from the timing controller 11, and apply data signals to the data lines SL(1) to SL(m).

The gate driver 24 receives the gate start pulse signal GSP, the gate clock signals GCK, the clear signal CLR, and the reference voltage VSS which are outputted from the level shifter circuit 13, and repeats application of active scanning signals to the scanning lines GL(1) to GL(n) with one vertical scanning period as a cycle. A detailed description of the gate driver 24 will be made later.

By applying the data signals to the data lines SL(1) to SL(m) and applying the scanning signals to the scanning lines GL(1) to GL(n) in the above-described manner, an image based on the image signal DAT transmitted from the external source is displayed on the display unit 22.

Note that in the present embodiment a drive control circuit is implemented by the timing controller 11 and the level shifter circuit 13.

Figure 4:
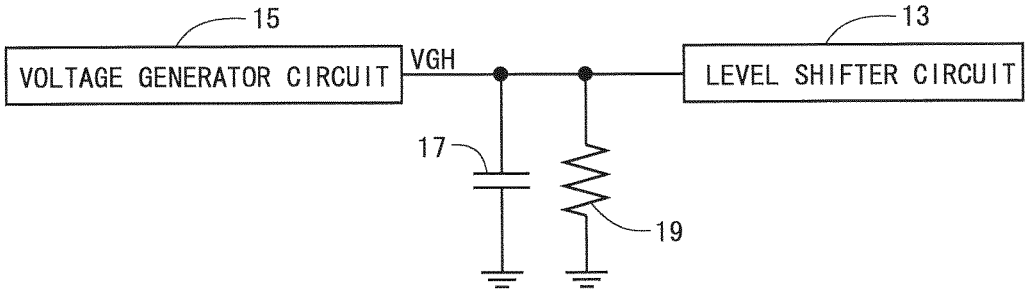
FIG. 4 is a diagram for describing a wiring line for supplying a gate-on voltage from a voltage generator circuit to a level shifter circuit in the first embodiment.

Meanwhile, in order that the voltage level of the gate-on voltage VGH gradually decreases in a slope manner when supply of power has stopped, a capacitor 17 and a resistor 19 are connected to a wiring line for supplying the gate-on voltage VGH from the voltage generator circuit 15 to the level shifter circuit 13, as shown in FIG. 4.

<1.2 Configuration of the Gate Driver>

<1.2.1 Overview>

Figure 5:
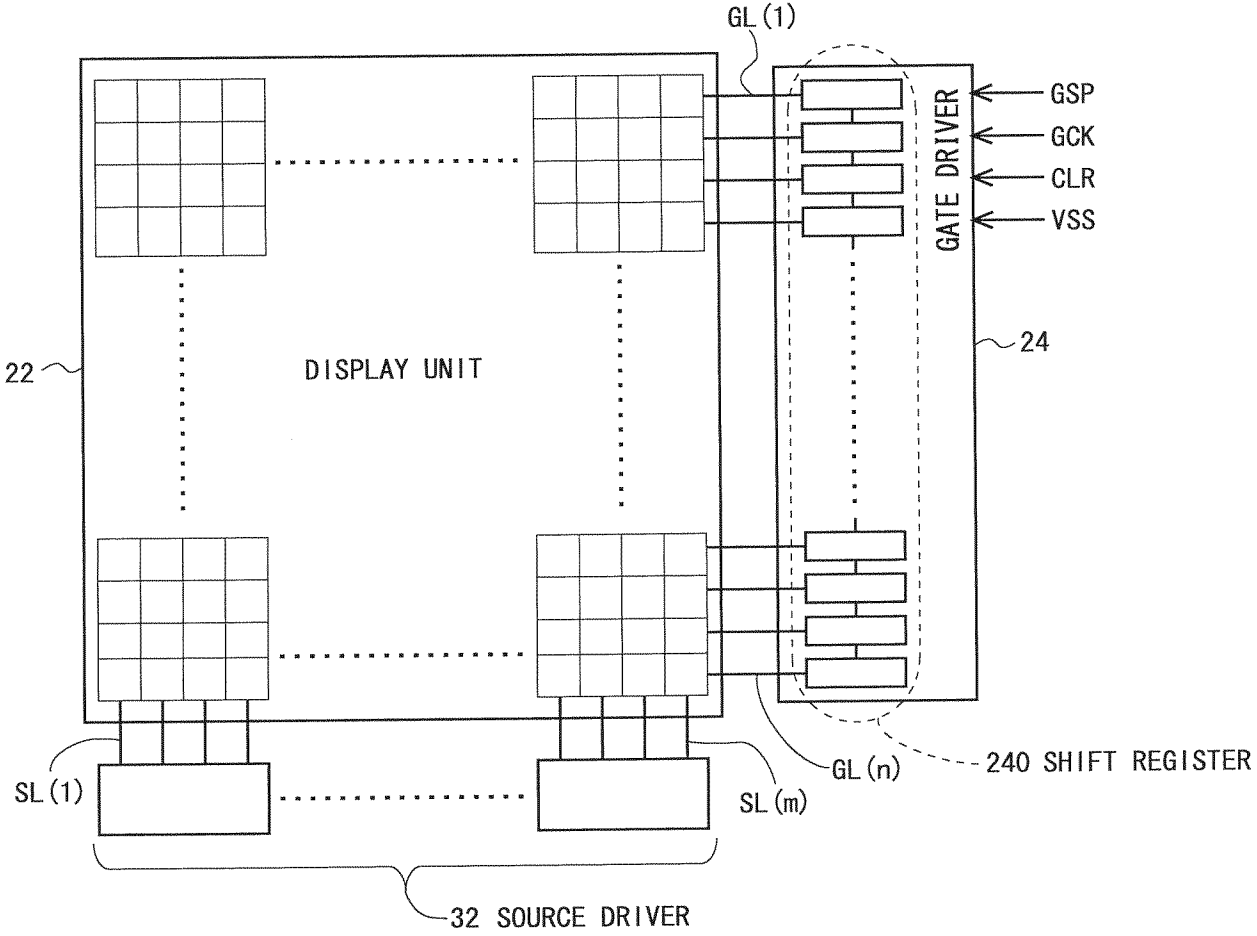
FIG. 5 is a block diagram for describing a configuration of a gate driver in the first embodiment.

FIG. 5 is a block diagram for describing a configuration of the gate driver 24. The gate driver 24 includes a shift register 240 including a plurality of stages. While there is formed a pixel matrix of n rows×m columns in the display unit 22, the stages of the shift register 240 are provided in one-to-one correspondence with the rows of the pixel matrix. Note that in the following a circuit that constitutes each stage of the shift register 240 is referred to as "unit circuit".

<1.2.2 Shift Register>

Figure 6:
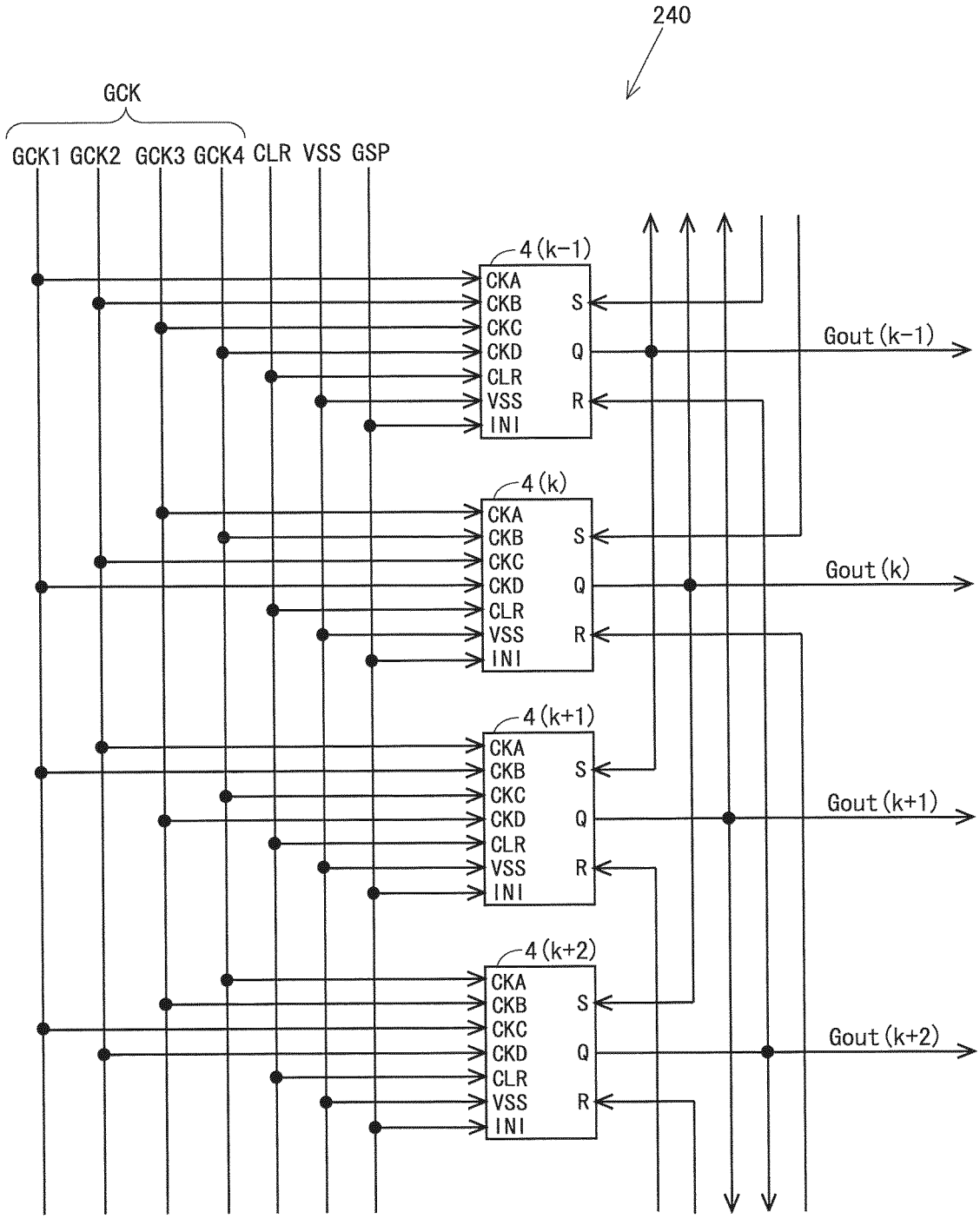
FIG. 6 is a block diagram showing a configuration of a shift register in the first embodiment.

FIG. 6 is a block diagram showing a configuration of a portion of the shift register 240 for four stages in the present embodiment. Here, with k being a given integer, attention is focused on unit circuits 4($k$−1), 4($k$), 4($k$+1), and 4($k$+2) of a (k−1)-th stage, a k-th stage, a (k+1)-th stage, and a (k+2)-th stage. A gate start pulse signal GSP, gate clock signals GCK, a clear signal CLR, and a reference voltage VSS are provided to the shift register 240. In the present embodiment, the gate clock signals GCK include four-phase clock signals (first to fourth gate clock signals GCK1 to GCK4).

Each unit circuit 4 includes input terminals for receiving a first clock CKA, a second clock CKB, a third clock CKC, a fourth clock CKD, a clear signal CLR, a reference voltage VSS, an initialization signal INI, a set signal S, and a reset signal R, and an output terminal for outputting an output signal Q.

To the unit circuit 4($k$−1) of the (k−1)-th stage, a first gate clock signal GCK1 is provided as the first clock CKA, a second gate clock signal GCK2 is provided as the second clock CKB, a third gate clock signal GCK3 is provided as the third clock CKC, and a fourth gate clock signal GCK4 is provided as the fourth clock CKD. To the unit circuit 4($k$) of the k-th stage, the third gate clock signal GCK3 is provided as the first clock CKA, the fourth gate clock signal GCK4 is provided as the second clock CKB, the second gate clock signal GCK2 is provided as the third clock CKC, and the first gate clock signal GCK1 is provided as the fourth clock CKD. To the unit circuit 4($k$+1) of the (k+1)-th stage, the second gate clock signal GCK2 is provided as the first clock CKA, the first gate clock signal GCK1 is provided as the second clock CKB, the fourth gate clock signal GCK4 is provided as the third clock CKC, and the third gate clock signal GCK3 is provided as the fourth clock CKD. To the unit circuit 4($k$+2) of the (k+2)-th stage, the fourth gate clock signal GCK4 is provided as the first clock CKA, the third gate clock signal GCK3 is provided as the second clock CKB, the first gate clock signal GCK1 is provided as the third clock CKC, and the second gate clock signal GCK2 is provided as the fourth clock CKD.

In addition, to each unit circuit 4, an output signal Q from a unit circuit 4 two stages before is provided as the set signal S, and an output signal Q from a unit circuit 4 three stages after is provided as the reset signal R. Note, however, that to a unit circuit 4(1) of the first stage and a unit circuit 4(2) of the second stage, the gate start pulse signal GSP is provided as the set signal S. To a unit circuit 4($n$−2) of an (n−2)-th stage, a unit circuit 4($n$−1) of an (n−1)-th stage, and a unit circuit 4($n$) of an n-th stage, the clear signal CLR is provided as the reset signal R. In addition, to each unit circuit 4, the gate start pulse signal GSP is provided as the initialization signal INI. Note, however, that to the unit circuit 4(1) of the first stage and the unit circuit 4(2) of the second stage, the reference voltage VSS is provided as the initialization signal INI. Note that the clear signal CLR and the reference voltage VSS are provided to all unit circuits 4 in a shared manner. An output signal Q from each unit circuit 4 is provided as a scanning signal Gout to a corresponding scanning line GL.

Figure 7:
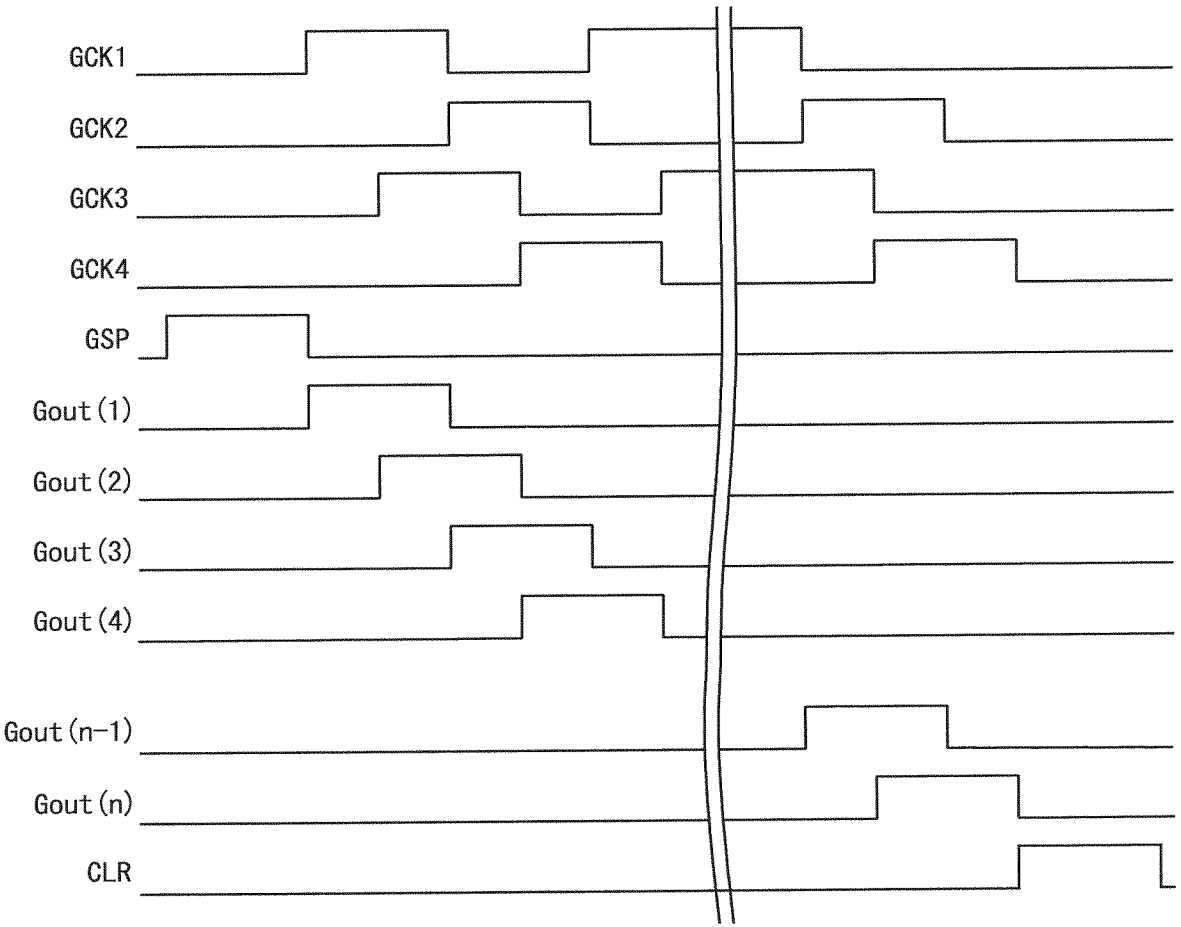
FIG. 7 is a waveform diagram for describing the operation of the shift register in the first embodiment.

In a configuration such as that described above, when a pulse of the gate start pulse signal GSP serving as the set signal S is provided to the unit circuit 4(1) of the first stage and the unit circuit 4(2) of the second stage, the pulse included in the gate start pulse signal GSP (the pulse is included in the output signal Q outputted from each unit circuit 4) is sequentially transferred from the unit circuit 4(1) of the first stage to the unit circuit 4($n$) of the n-th stage, based on the gate clock signals GCK (the first to fourth gate clock signals GCK1 to GCK4). Then, in response to the transfer of the pulse (shift operation), the output signals Q outputted from the unit circuits 4(1) to 4($n$) of the first to n-th stages sequentially go to a high level. By this, scanning signals Gout(1) to Gout(n) that go to a high level for a predetermined period as shown in FIG. 7 are provided to the scanning lines GL(1) to GL(n) in the display unit 22.

<1.2.3 Unit Circuit>

Figure 8:
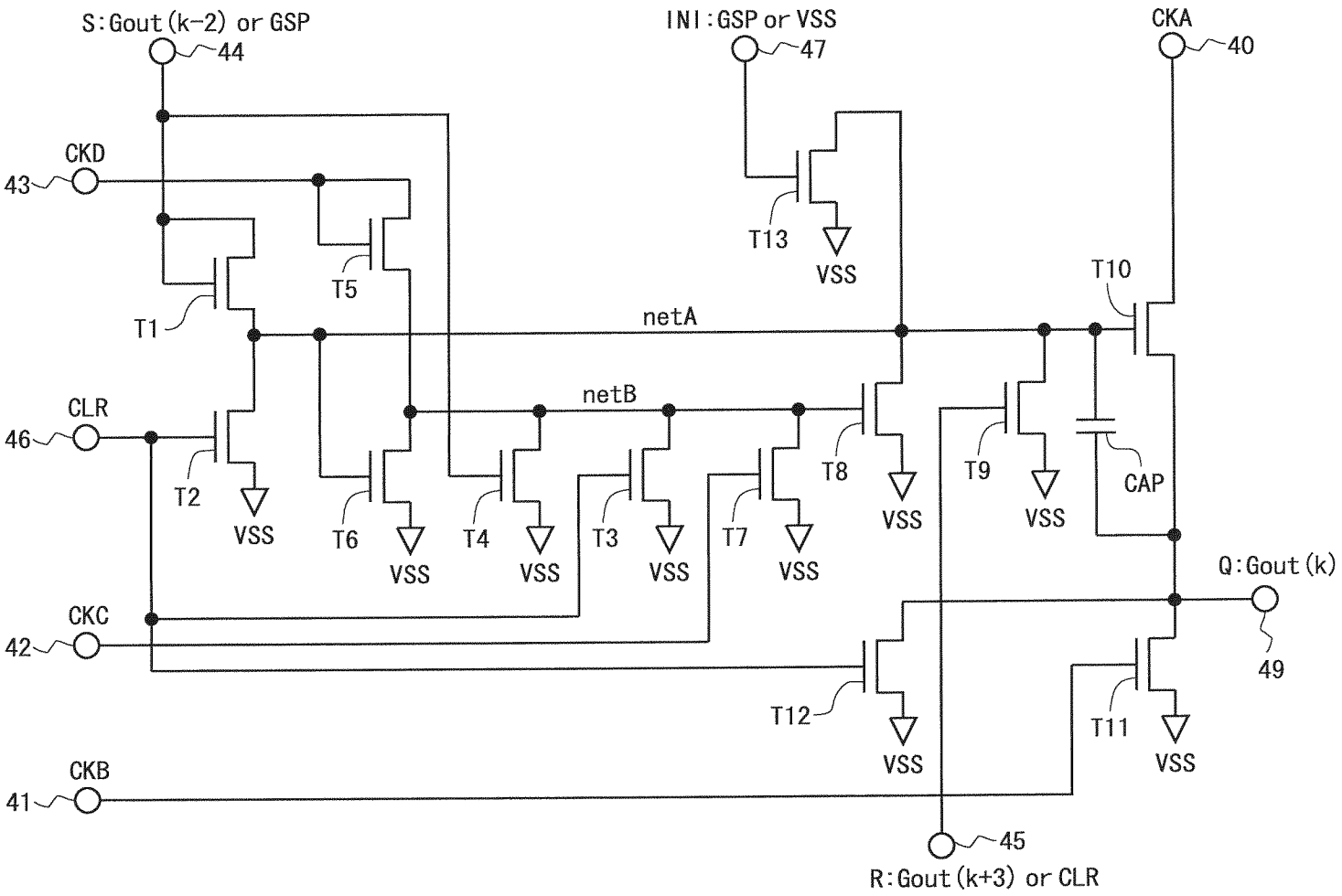
FIG. 8 is a circuit diagram showing a configuration of a unit circuit in the first embodiment.

FIG. 8 is a circuit diagram showing a configuration of a unit circuit 4 (which is assumed to be the k-th stage) in the present embodiment. As shown in FIG. 8, the unit circuit 4 includes 13 thin-film transistors T1 to T13 and one capacitor CAP. In addition, the unit circuit 4 has eight input terminals 40 to 47 and one output terminal (output node) 49, in addition to an input terminal connected to a reference voltage wiring line (a wiring line for transmitting the reference voltage VSS). In FIG. 8, an input terminal for receiving the first clock CKA is given reference character 40, an input terminal for receiving the second clock CKB is given reference character 41, an input terminal for receiving the third clock CKC is given reference character 42, an input terminal for receiving the fourth clock CKD is given reference character 43, an input terminal for receiving the set signal S is given reference character 44, an input terminal for receiving the reset signal R is given reference character 45, an input terminal for receiving the clear signal CLR is given reference character 46, an input terminal for receiving the initialization signal INI is given reference character 47, and an output terminal for outputting the output signal Q is given reference character 49.

The source terminal of the thin-film transistor T1, the drain terminal of the thin-film transistor T2, the gate terminal of the thin-film transistor T6, the drain terminal of the thin-film transistor T8, the drain terminal of the thin-film transistor T9, the gate terminal of the thin-film transistor T10, the source terminal of the thin-film transistor T13, and one end of the capacitor CAP are connected to each other. Note that a region (wiring line) where they are connected to each other is referred to as "output control node". The output control node is given reference character netA. The drain terminal of the thin-film transistor T3, the drain terminal of the thin-film transistor T4, the source terminal of the thin-film transistor T5, the drain terminal of the thin-film transistor T6, the drain terminal of the thin-film transistor T7, and the gate terminal of the thin-film transistor T8 are connected to each other. Note that a region (wiring line) where they are connected to each other is referred to as "stabilization node". The stabilization node is given reference character netB.

The thin-film transistor T1 is connected at its gate and drain terminals to the input terminal 44 (i.e. diode-connected), and connected at its source terminal to the output control node netA. The thin-film transistor T2 is connected at its gate terminal to the input terminal 46, connected at its drain terminal to the output control node netA, and connected at its source terminal to the reference voltage wiring line. The thin-film transistor T3 is connected at its gate terminal to the input terminal 46, connected at its drain terminal to the stabilization node netB, and connected at its source terminal to the reference voltage wiring line. The thin-film transistor T4 is connected at its gate terminal to the input terminal 44, connected at its drain terminal to the stabilization node netB, and connected at its source terminal to the reference voltage wiring line. The thin-film transistor T5 is connected at its gate and drain terminals to the input terminal 43 (i.e., diode-connected), and connected at its source terminal to the stabilization node netB.

The thin-film transistor T6 is connected at its gate terminal to the output control node netA, connected at its drain terminal to the stabilization node netB, and connected at its source terminal to the reference voltage wiring line. The thin-film transistor T7 is connected at its gate terminal to the input terminal 42, connected at its drain terminal to the stabilization node netB, and connected at its source terminal to the reference voltage wiring line. The thin-film transistor T8 is connected at its gate terminal to the stabilization node netB, connected at its drain terminal to the output control node netA, and connected at its source terminal to the reference voltage wiring line. The thin-film transistor T9 is connected at its gate terminal to the input terminal 45, connected at its drain terminal to the output control node netA, and connected at its source terminal to the reference voltage wiring line. The thin-film transistor T10 is connected at its gate terminal to the output control node netA, connected at its drain terminal to the input terminal 40, and connected at its source terminal to the output terminal 49.

The thin-film transistor T11 is connected at its gate terminal to the input terminal 41, connected at its drain terminal to the output terminal 49, and connected at its source terminal to the reference voltage wiring line. The thin-film transistor T12 is connected at its gate terminal to the input terminal 46, connected at its drain terminal to the output terminal 49, and connected at its source terminal to the reference voltage wiring line. The thin-film transistor T13 is connected at its gate terminal to the input terminal 47, connected at its drain terminal to the reference voltage wiring line, connected at its source terminal to the output control node netA. The capacitor CAP is connected at its one end to the output control node netA and connected at its other end to the output terminal 49.

Note that, in the present embodiment, a reset transistor is implemented by the thin-film transistor T2, and an output control transistor is implemented by the thin-film transistor T10.

<1.3 Operation Performed at Normal Times>

Figure 9:
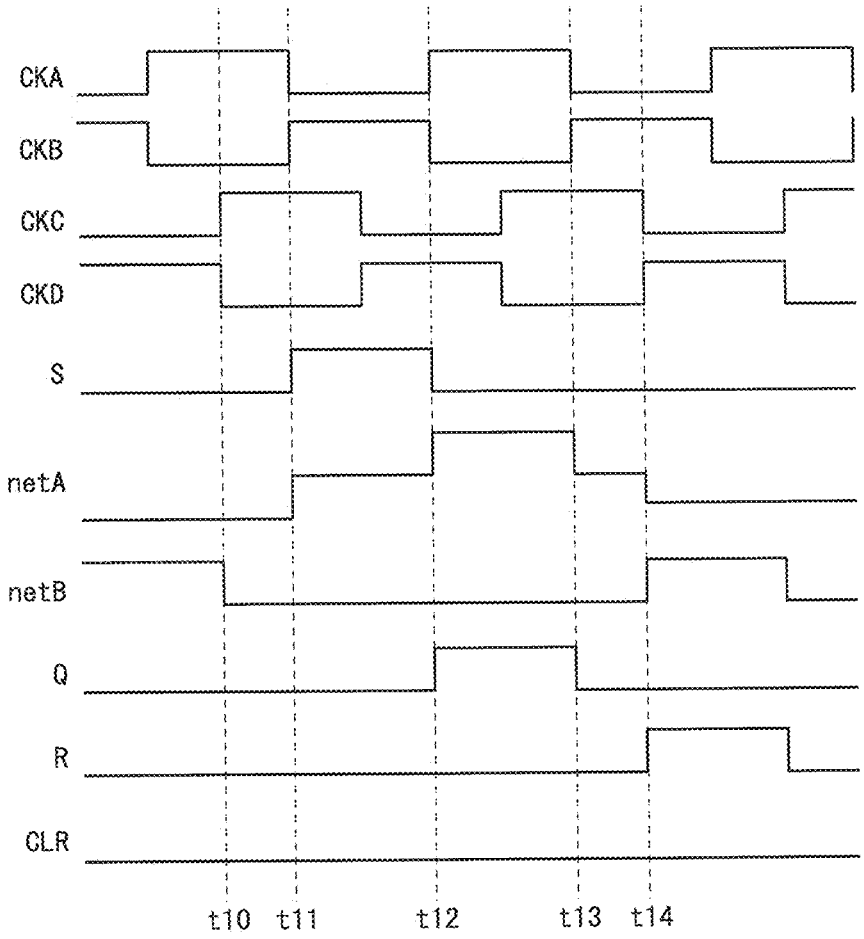
FIG. 9 is a waveform diagram for describing the operation of the unit circuit at normal times in the first embodiment.

With reference to FIG. 9, the operation of the unit circuit 4 performed at normal times will be described. During a period during which the liquid crystal display device 100 is operating, the first clock CKA, the second clock CKB, the third clock CKC, and the fourth clock CKD whose on-duty is set to about 50% are provided to the unit circuit 4.

During a period before time point t10, the voltage at the output control node netA is maintained at a low level, the voltage at the stabilization node netB is maintained at a high level, and the output signal Q is maintained at a low level.

At time point t10, the third clock CKC changes from a low level to a high level. By this, the thin-film transistor T7 goes into an on state, and the voltage at the stabilization node netB goes to a low level.

At time point t11, the set signal S changes from a low level to a high level. Since the thin-film transistor T1 is diode-connected as shown in FIG. 8, the thin-film transistor T1 goes into an on state by a pulse of the set signal S, and the capacitor CAP is charged. By this, the voltage at the output control node netA changes from the low level to a high level, and the thin-film transistor T10 goes into an on state. However, since the first clock CKA is at a low level during a period from time point t11 to time point t12, the output signal Q is maintained at the low level. In addition, by the thin-film transistor 14 going into an on state by the pulse of the set signal S, the voltage at the stabilization node netB is drawn to a low level.

At time point t12, the first clock CKA changes from the low level to a high level. At this time, since the thin-film transistor T10 is in an on state, the voltage at the output terminal 49 increases with an increase in the voltage at the input terminal 40. Here, since the capacitor CAP is provided between the output control node netA and the output terminal 49 as shown in FIG. 8, the voltage at the output control node netA also increases with the increase in the voltage at the output terminal 49 (the output control node netA goes into a boost state). As a result, a large voltage applies to the gate terminal of the thin-film transistor T10, and the voltage of the output signal Q increases to a sufficient level for a scanning line GL connected to the output terminal 49 to go into a selected state.

At time point t13, the first clock CKA changes from the high level to a low level. By this, the voltage at the output terminal 49 (the voltage of the output signal Q) decreases with a decrease in the voltage at the input terminal 40. When the voltage at the output terminal 49 decreases, the voltage at the output control node netA also decreases through the capacitor CAP. In addition, at time point t13, the second clock CKB changes from a low level to a high level. By this, the thin-film transistor T11 goes into an on state, and the voltage at the output terminal 49 (the voltage of the output signal Q) goes to a low level.

At time point t14, the reset signal R changes from a low level to a high level. By this, the thin-film transistor T9 goes into an on state. As a result, the voltage at the output control node netA goes to a low level. In addition, at time point t14, the fourth clock CKD changes from a low level to a high level. Since the thin-film transistor T5 is diode-connected as shown in FIG. 8, the thin-film transistor T5 goes into an on state and the voltage at the stabilization node netB goes to a high level.

By performing operation such as that described above by each unit circuit 4 in the shift register 240, scanning signals Gout(1) to Gout(n) that go to a high level for a predetermined period as shown in FIG. 7 are provided to the scanning lines GL(1) to GL(n) in the display unit 22. In addition, at that time, in each unit circuit 4, since the thin-film transistor T8 goes into an on state by the stabilization node netB going to a high level every predetermined period, even when noise caused by the clock operation of the first clock CKA mixes in the output control node netA, the voltage at the output control node netA is drawn to a low level. By this, the occurrence of abnormal operation caused by the clock operation of the first clock CKA is suppressed.

Meanwhile, the clear signal CLR changes from a low level to a high level after all scanning signals Gout(1) to Gout(n) go to a high level in each vertical scanning period (see FIG. 7). By this, the internal states of all unit circuits 4(1) to 4(*n*) are reset (initialized) and the states of all scanning lines GL(1) to GL(n) are reset (initialized).

<1.4 Configuration of the Power Supply>

As described above, in the conventional configurations, two slope power supplies are used to remove residual charge in the panel, and thus, a large number of circuit elements are required, resulting in high cost. Hence, in order to simplify the configuration of power supplies, the applicant of the present application has reexamined areas where removal of charge is essential upon power-off. As a result, a conclusion has been reached that removal of charge is essential for the pixel formation portions and the scanning lines GL that perform on/off control of the thin-film transistors 220 in the pixel formation portions, because the residual charge in the pixel formation portions directly causes a deterioration in liquid crystal, but removal of charge does not necessarily need to be performed for floating nodes (the output control node netA and the stabilization node netB) in each unit circuit 4 included in the shift register 240 composing the gate driver 24.

Regarding the floating nodes, as long as the voltages of other signals related to the floating nodes are reduced to the voltage of the ground GND, any potential does not affect the display. Therefore, in order to securely discharge charge on the scanning lines GL, it is actually better to leave charge at the floating nodes. Hence, in the present embodiment, the voltage of the clear signal CLR that contributes to removal of charge at the floating nodes is set to the voltage of the ground GND when supply of power has stopped, and the number of the slope power supply that needs to be prepared is only one. Specifically, a single power supply system configuration that uses a voltage of only one channel as a scanning line selection voltage is adopted, and the setting of each signal related to an off sequence is performed as follows.

Figure 10:
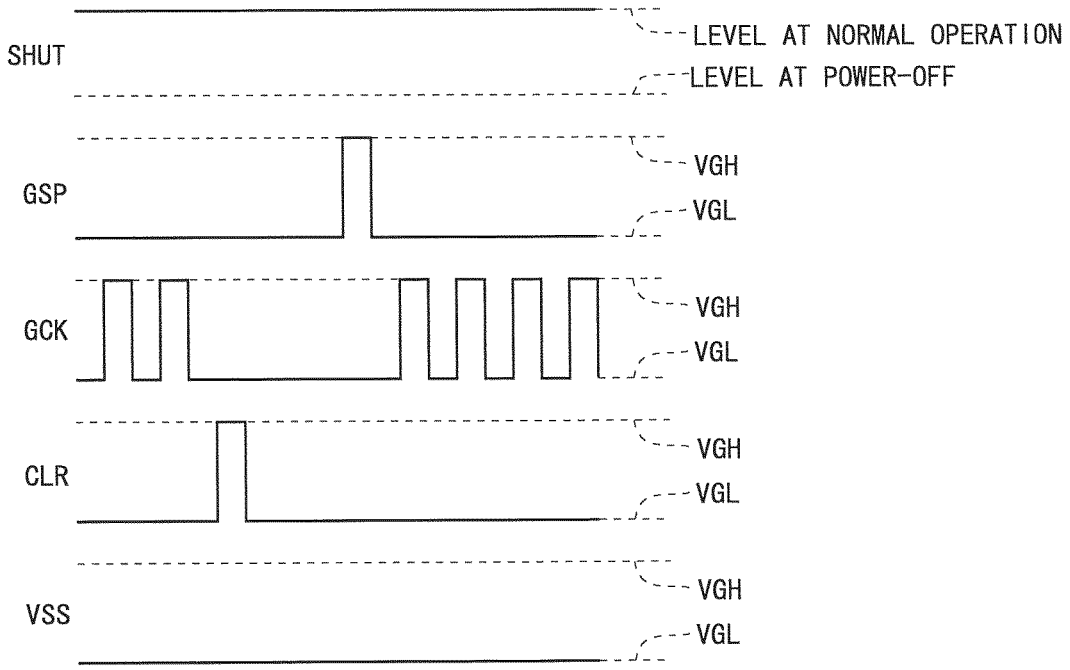
FIG. 10 is a diagram for describing changes in the voltages of signals at normal times in the first embodiment.
Figure 20:
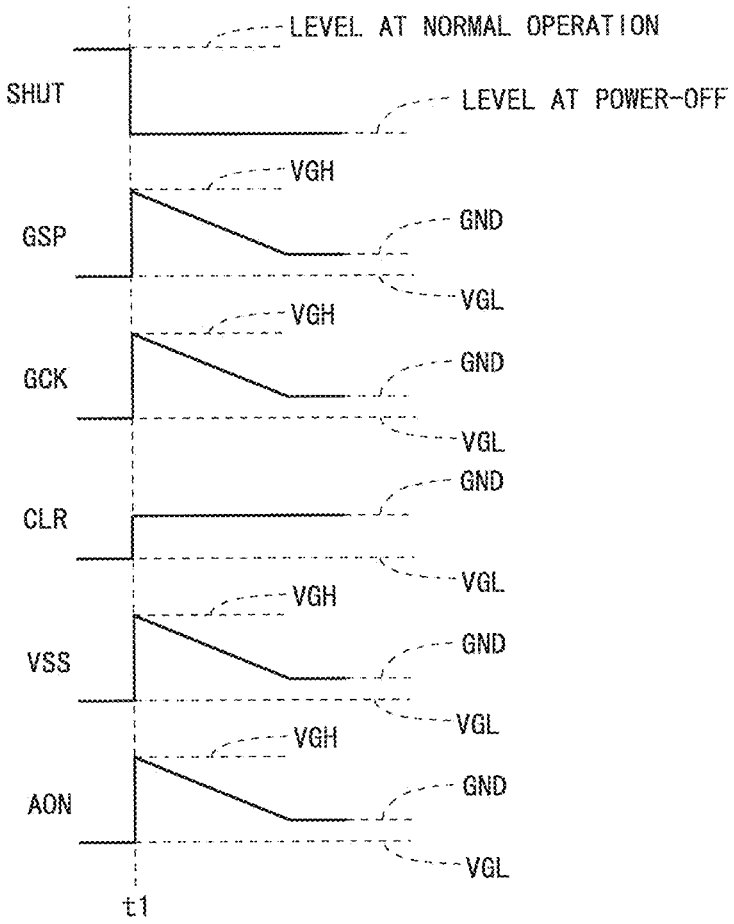
FIG. 20 is a diagram for describing changes in the voltages of signals when supply of power has stopped in the second embodiment.

At normal operation (when power is normally supplied), the voltage of the gate start pulse signal GSP, the voltages of the gate clock signals GCK, and the voltage of the clear signal CLR are set to the gate-on voltage VGH or the gate-off voltage VGL, and the reference voltage VSS is set to the gate-off voltage VGL. Specifically, when the power supply state signal SHUT indicates that power is normally supplied, the level shifter circuit 13 sets the voltage of the gate start pulse signal GSP, the voltages of the gate clock signals GCK, and the voltage of the clear signal CLR to the gate-on voltage VGH or the gate-off voltage VGL, based on the gate start pulse signal GSP_o, the gate clock signals GCK_o, and the clear signal CLR_o, and sets the reference voltage VSS to the gate-off voltage VGL (see FIGS. 2 and 10). When the supply of power has stopped, the voltage of the gate start pulse signal GSP, the voltages of the gate clock signals GCK, and the reference voltage VSS are set to the gate-on voltage VGH, and the voltage of the clear signal CLR is set to the voltage of the ground GND. Specifically, when the power supply state signal SHUT indicates that the supply of power has stopped, the level shifter circuit 13 sets the voltage of the gate start pulse signal GSP, the voltages of the gate clock signals GCK, and the reference voltage VSS to the gate-on voltage VGH, and sets the voltage of the clear signal CLR to the voltage of the ground GND (see FIG. 1). Note that in FIG. 1 a point in time when the supply of power has stopped is indicated by reference character t1 (the same also applies to FIGS. 13, 15, and 20).

<1.5 Operation Performed when Supply of Power has Stopped>

<1.5.1 Overview>

Figure 1:
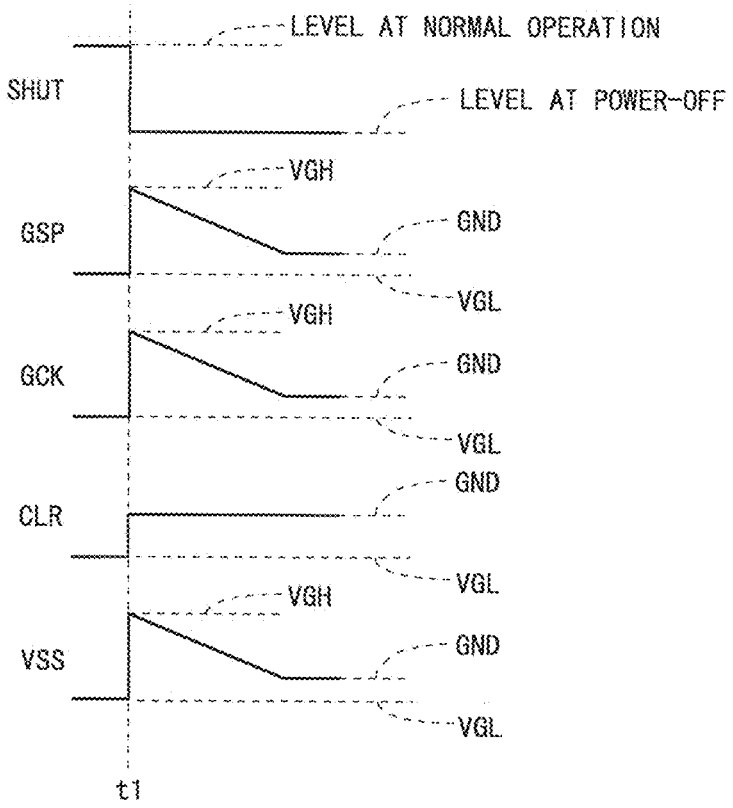
FIG. 1 is a diagram for describing changes in the voltages of signals when supply of power has stopped in a first embodiment.

Next, operation performed when supply of power has stopped will be described. When supply of power has stopped, the power-off detecting unit 112 informs the level shifter circuit 13 that supply of power has stopped, by a power supply state signal SHUT. By this, as shown in FIG. 1, the level shifter circuit 13 sets the voltage of the gate start pulse signal GSP, the voltages of the gate clock signals GCK, and the reference voltage VSS to the gate-on voltage VGH, and sets the voltage of the clear signal CLR to the voltage of the ground GND.

By setting the voltages of the gate clock signals GCK to the gate-on voltage VGH, the gate-on voltage VGH is provided to the input terminal 40 of each unit circuit 4. In addition, by setting the voltage of the gate start pulse signal GSP and the reference voltage VSS to the gate-on voltage VGH, the gate-on voltage VGH is provided as the initialization signal INI to the gate terminal of the thin-film transistor T13, with the drain terminal of the thin-film transistor T13 provided with the gate-on voltage VGH. By this, charge is supplied to the output control node netA through the thin-film transistor T13, and the thin-film transistor T10 goes into an on state. Furthermore, by setting the voltages of the gate clock signals GCK and the reference voltage VSS to the gate-on voltage VGH, the gate-on voltage VGH is provided to the gate and source terminals of the thin-film transistor T11. By this, charge is supplied to the output terminal 49 through the thin-film transistor T11. By the above, the output signal Q from each unit circuit 4 goes to a high level. That is, all scanning lines GL(1) to GL(n) go into a selected state. At this time, a black voltage is applied to all data lines SL(1) to SL(m). As a result, charge accumulated in the pixel capacitance CP in each pixel formation portion is discharged.

In addition, after setting the voltage of the gate start pulse signal GSP, the voltages of the gate clock signals GCK, and the reference voltage VSS to the gate-on voltage VGH immediately after the stop of supply of power, each of those voltages gradually decreases. By this, the voltage at the output terminal 49 decreases in each unit circuit 4 and the voltage of each scanning signal Gout eventually reaches the voltage of the ground GND. In this manner, charge on each scanning line GL is discharged.

<1.5.2 Simulation Results>

Next, simulation results about operation performed upon power-off will be described. Here, first, as a comparative example, operation in a case in which the voltage of the clear signal CLR in addition to the voltage of the gate start pulse signal GSP, the voltages of the gate clock signals GCK, and the reference voltage VSS is set to the gate-on voltage VGH after the stop of supply of power will be described. Thereafter, operation of the present embodiment will be described.

<1.5.2.1 Comparative Example>

Figure 11:
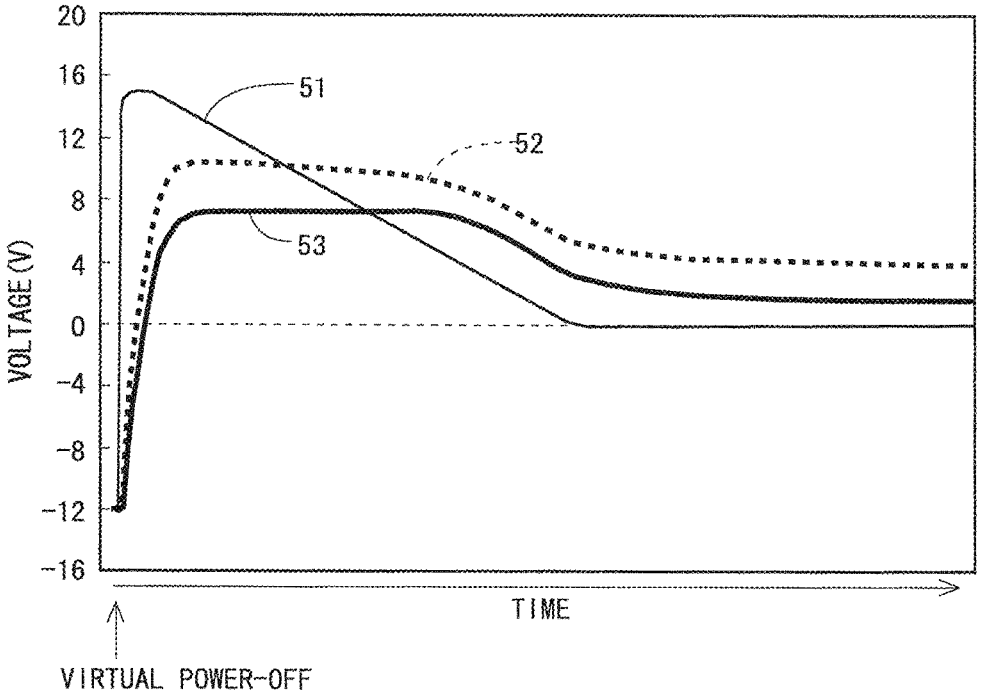
FIG. 11 is a diagram showing simulation results of a comparative example.

FIG. 11 is a diagram showing simulation results of the comparative example. Note that in FIG. 11 a voltage waveform of the gate clock signal GCK, a voltage waveform of the output control node netA, and a voltage waveform of the scanning signal Gout are given reference characters 51, 52, and 53, respectively. According to the simulation results, the voltage of the scanning signal Gout is increased to a high level immediately after power-off in order to remove charge in the pixel formation portions. Thereafter, the voltage of the scanning signal Gout is maintained at the high level and then gradually decreases. However, as can be grasped from FIG. 11, the voltage of the scanning signal Gout does not reach the voltage of the ground GND.

Figure 27:
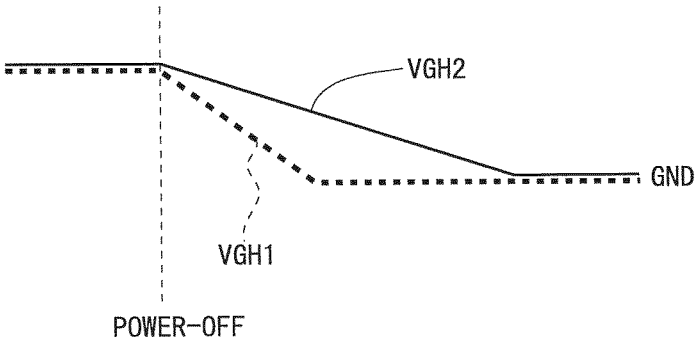
FIG. 27 is a diagram for describing a two power supply system configuration.

As described above, in a case in which the voltage VGH2 out of the two types of voltages VGH1 and VGH2 shown in FIG. 27 is simply replaced by the voltage VGH1, upon the stop of supply of power, charge on the scanning lines GL is not removed. Therefore, there is a possibility that display failure, such as flicker caused by residual charge, occurs upon power-on.

<1.5.2.2 Case of the Present Embodiment>

Figure 12:
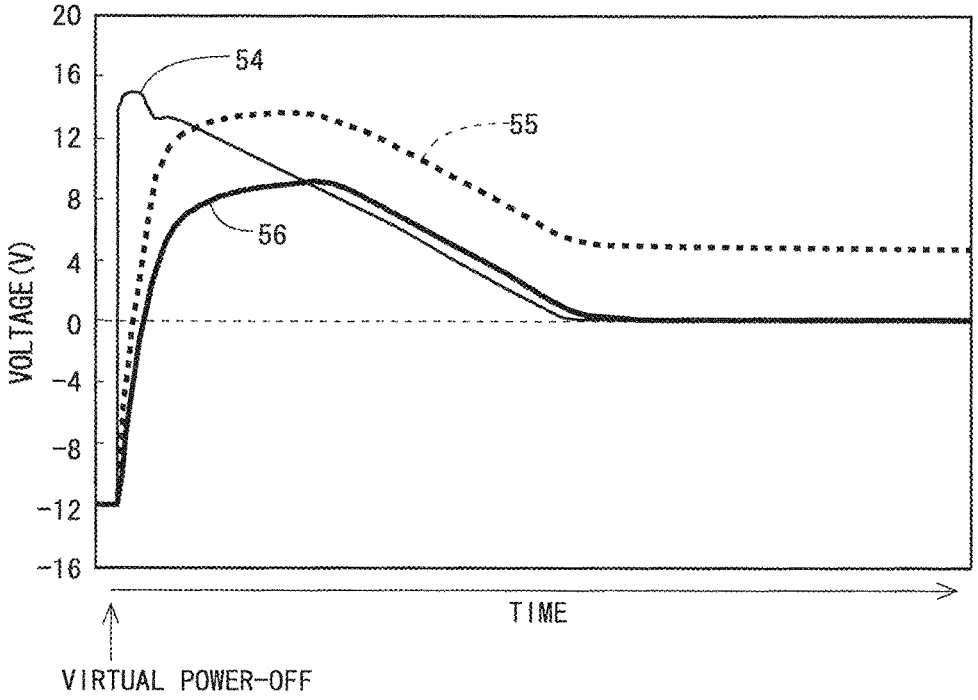
FIG. 12 is a diagram showing simulation results in the first embodiment.

FIG. 12 is a diagram showing simulation results in the present embodiment. Note that in FIG. 12 a voltage waveform of the gate clock signal GCK, a voltage waveform of the output control node netA, and a voltage waveform of the scanning signal Gout are given reference characters 54, 55, and 56, respectively. According to the simulation results, immediately after power-off, the voltage of the scanning signal Gout is increased to a high level in order to remove charge in the pixel formation portions. Thereafter, the voltage of the scanning signal Gout is maintained at the high level and then decreases with a decrease in the voltage of the gate clock signal GCK. Then, the voltage of the scanning signal Gout reaches the voltage of the ground GND after a lapse of a predetermined time from the power-off. A reason that the voltage of the scanning signal Gout thus reaches the voltage of the ground GND is that since the voltage of the clear signal CLR is set to the voltage of the ground GND after the stop of supply of power, the voltage at the output control node netA is maintained at a relatively high level, by which discharge through the thin-film transistor T10 (see FIG. 8) is effectively performed. In other words, after the stop of supply of power, the thin-film transistor T10 is maintained in an on state, and the voltage of the scanning signal Gout follows a change in the voltage (gate-on voltage VGH) at the input terminal 40.

From simulation results such as those described above, it can be grasped that, according to the present embodiment, when supply of power has stopped, charge in the pixel formation portions and charge on the scanning lines GL are removed.

Note that according to the present embodiment residual charge occurs in the output control node netA. Due to this, there is a concern about a deterioration in the characteristics of thin-film transistors connected to the output control node netA. However, according to the current manufacturing process of IGZO-TFTs, an increase in mobility and a reduction in threshold shift are proceeding, and therefore a deterioration in the characteristics of thin-film transistors caused by stress (bias) is very small. Therefore, there is almost no influence on the shift operation of the shift register 240 by residual charge at the output control node netA.

<1.6 Effects>

According to the present embodiment, when supply of power has stopped, the voltages of the GDM signals are set as follows. The clear signal CLR that contributes to removal of charge at the floating nodes (the output control node netA and the stabilization node netB) in each unit circuit 4 included in the shift register 240 is set to the voltage of the ground GND, and other signals (the gate start pulse signal GSP, the gate clock signals GCK, and the reference voltage VSS) are set to the gate-on voltage VGH. In order to implement such settings, a single power supply system configuration that uses a voltage of only one channel as a scanning line selection voltage is adopted. Hence, compared to the two power supply system configuration, the number of circuit elements required is reduced, and cost is reduced. In addition, by setting signals other than the clear signal CLR to the gate-on voltage VGH when supply of power has stopped, each scanning line GL goes into a selected state and charge accumulated in the pixel capacitance CP in each pixel formation portion is discharged. Thereafter, by a decrease in the level of the gate-on voltage VGH, charge on the scanning lines GL is also discharged. Here, there is almost no influence on display by residual charge at the floating nodes in the unit circuits 4. By the above, according to the present embodiment, it becomes possible for a liquid crystal display device that adopts IGZO-TFTs which are TFTs with excellent off characteristics to suppress the occurrence of display failure caused by residual charge, with a simple configuration.

<1.7 Variants>

Variants of the first embodiment will be described.

<1.7.1 First Variant>

Figure 13:
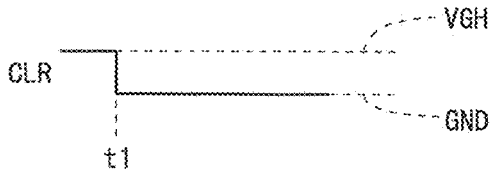
FIG. 13 is a waveform diagram for describing a voltage of a clear signal in a first variant of the first embodiment.

In the first embodiment, it is premised that the voltage of the clear signal CLR is being set to the gate-off voltage VGL immediately before supply of power stops (see FIG. 1). However, the configuration is not limited thereto, and the configuration may be such that the voltage of the clear signal CLR is being set to the gate-on voltage VGH immediately before supply of power stops. That is, in the present variant, as shown in FIG. 13, the voltage of the clear signal CLR is being set to the gate-on voltage VGH immediately before supply of power stops, and when the supply of power stops, the voltage of the clear signal CLR is set to the voltage of the ground GND.

Figure 14:
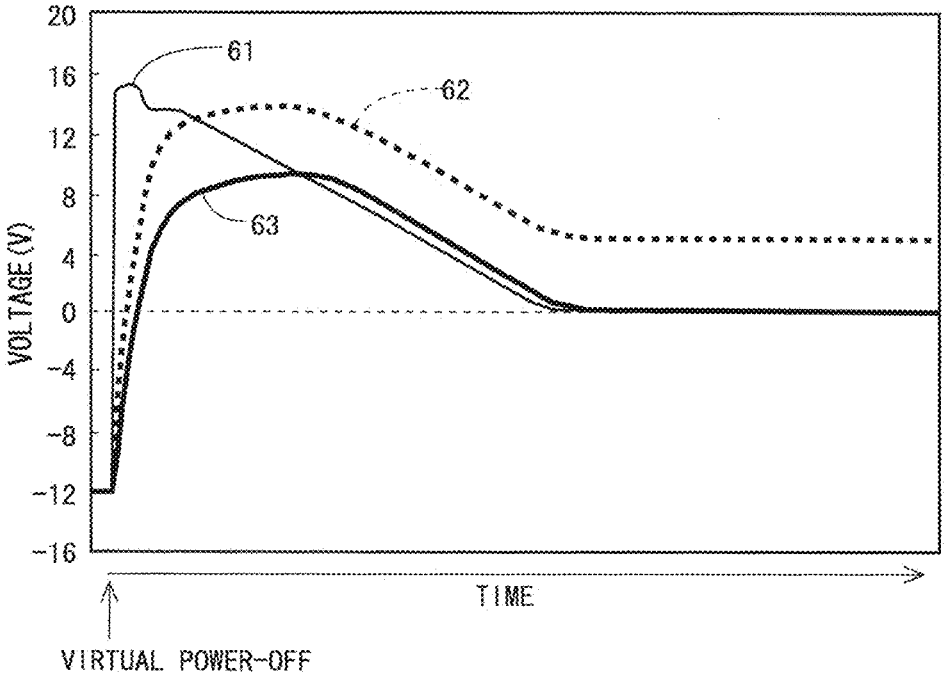
FIG. 14 is a diagram showing simulation results in the first variant of the first embodiment.

FIG. 14 is a diagram showing simulation results in the present variant. Note that in FIG. 14 a voltage waveform of the gate clock signal GCK, a voltage waveform of the output control node netA, and a voltage waveform of the scanning signal Gout are given reference characters 61, 62, and 63, respectively. As can be grasped from the simulation results, also in the present variant, the voltage of the scanning signal Gout is increased to a high level immediately after power-off in order to remove charge in the pixel formation portions, and reaches the voltage of the ground GND after a lapse of a predetermined time from the power-off. Therefore, when supply of power has stopped, charge in the pixel formation portions and charge on the scanning lines GL are removed.

<1.7.2 Second Variant>

Figure 15:
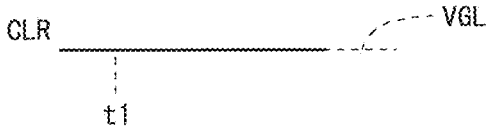
FIG. 15 is a waveform diagram for describing the voltage of the clear signal in a second variant of the first embodiment.

In the first embodiment, when supply of power stops, the voltage of the clear signal CLR is set to the voltage of the ground GND. However, the configuration is not limited thereto, and the voltage of the clear signal CLR may be set to the gate-off voltage VGL when supply of power stops. That is, in the present variant, as shown in FIG. 15, the voltage of the clear signal CLR is being set to the gate-off voltage VGL immediately before supply of power stops and the voltage of the clear signal CLR is set to the gate-off voltage VGL also after the stop of the supply of power. Note that, as shown in FIG. 7, the clear signal CLR is set to the gate-on voltage VGH only for a predetermined period after all scanning signals Gout(1) to Gout(n) go to a high level in each vertical scanning period.

Figure 16:
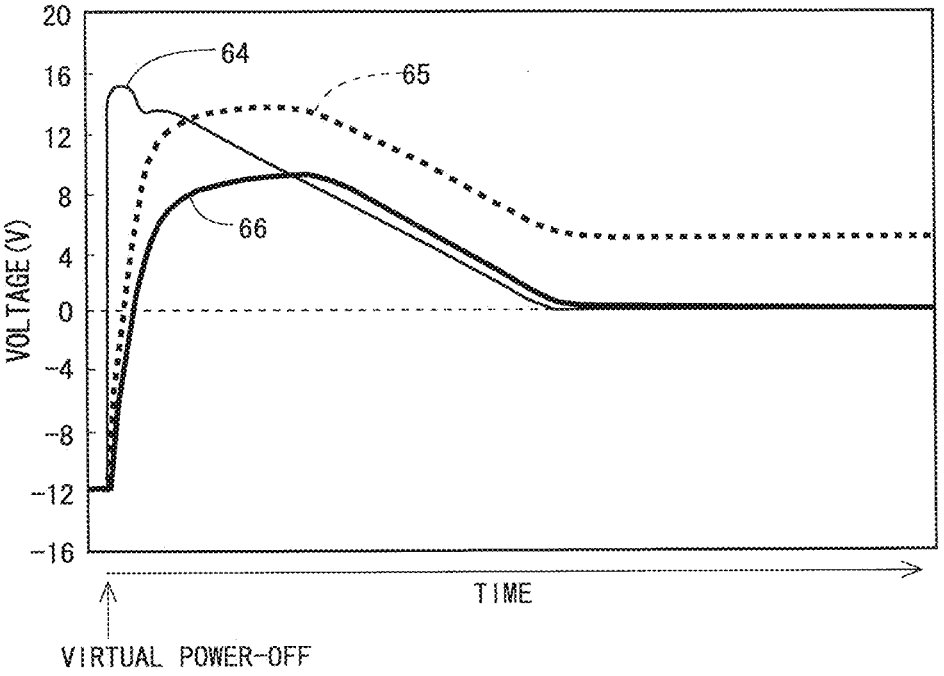
FIG. 16 is a diagram showing simulation results of the second variant in the first embodiment.

FIG. 16 is a diagram showing simulation results in the present variant. Note that in FIG. 16 a voltage waveform of the gate clock signal GCK, a voltage waveform of the output control node netA, and a voltage waveform of the scanning signal Gout are given reference characters 64, 65, and 66, respectively. As can be grasped from the simulation results, also in the present variant, the voltage of the scanning signal Gout is increased to a high level immediately after power-off in order to remove charge in the pixel formation portions, and reaches the voltage of the ground GND after a lapse of a predetermined time from the power-off. Therefore, when supply of power has stopped, charge in the pixel formation portions and charge on the scanning lines GL are removed.

Note that the voltage of the clear signal CLR after the stop of supply of power may be set to a voltage other than the gate-off voltage VGL as long as the voltage is less than or equal to the voltage of the ground GND. Note, however, that it is preferred that the voltage of the clear signal CLR after the stop of supply of power be set to the voltage of the ground GND in terms of reducing the number of power supplies.

2. Second Embodiment

<2.1 Configuration>

In the present embodiment, a thin-film transistor for an off sequence is provided in each unit circuit 4, and the on/off of the thin-film transistor is controlled by an off control signal transmitted through a dedicated wiring line. The off control signal is hereinafter given reference character AON.

The overall configuration is substantially the same as that of the first embodiment (see FIG. 2). Note, however, that in the present embodiment the level shifter circuit 13 generates the above-described off control signal AON in addition to the signals generated in the first embodiment. That is, the level shifter circuit 13 generates an off control signal AON, based on a power supply state signal SHUT. The off control signal AON is transmitted from the level shifter circuit 13 to the gate driver 24 through the dedicated wiring line.

Figure 17:
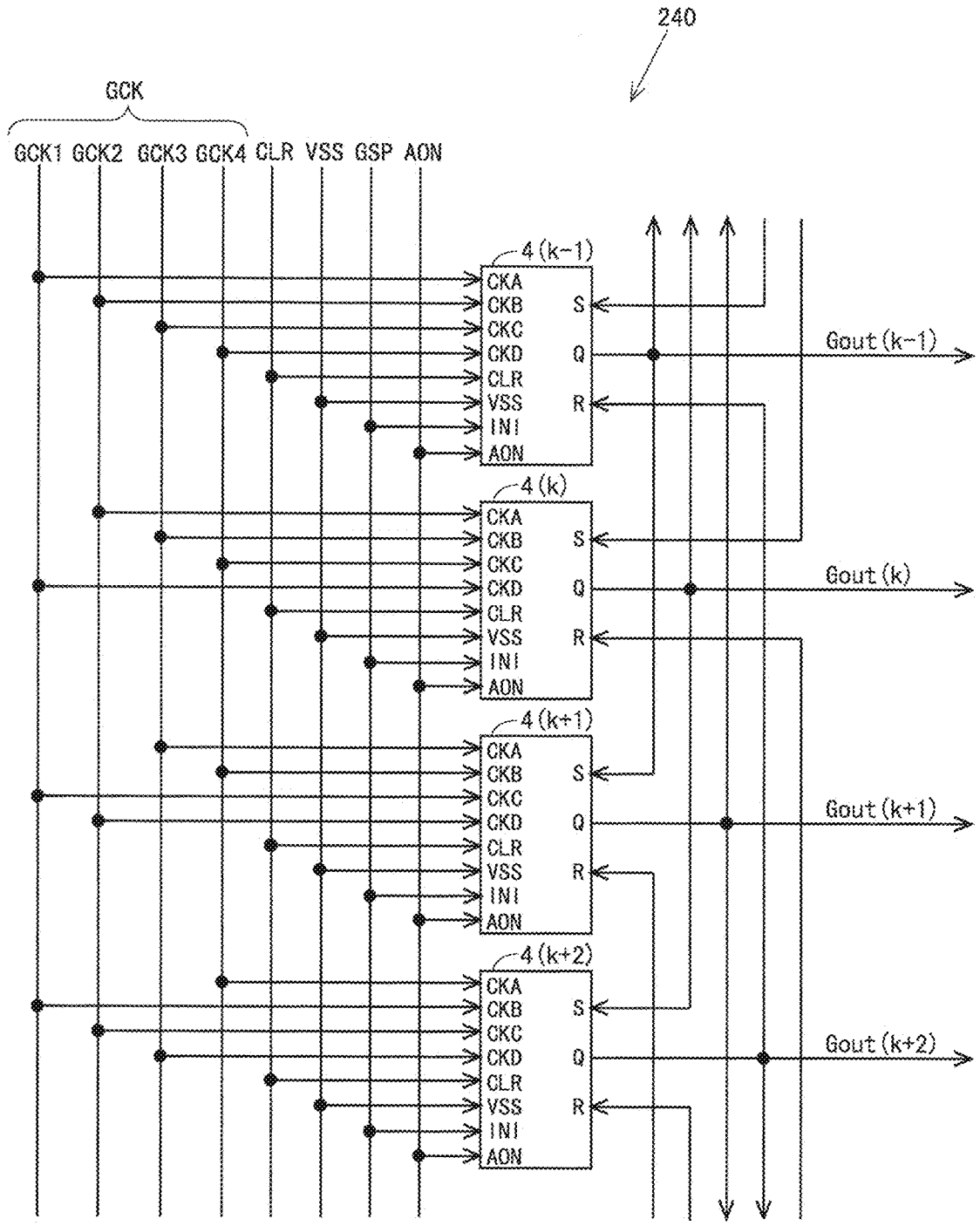
FIG. 17 is a block diagram showing a configuration of a shift register in a second embodiment.

FIG. 17 is a block diagram showing a configuration of a portion of the shift register 240 for four stages in the present embodiment. Each unit circuit 4 is provided with an input terminal for receiving the off control signal AON, in addition to the input terminals provided in the first embodiment. The off control signal AON is provided to all unit circuits 4 in a shared manner.

Figure 18:
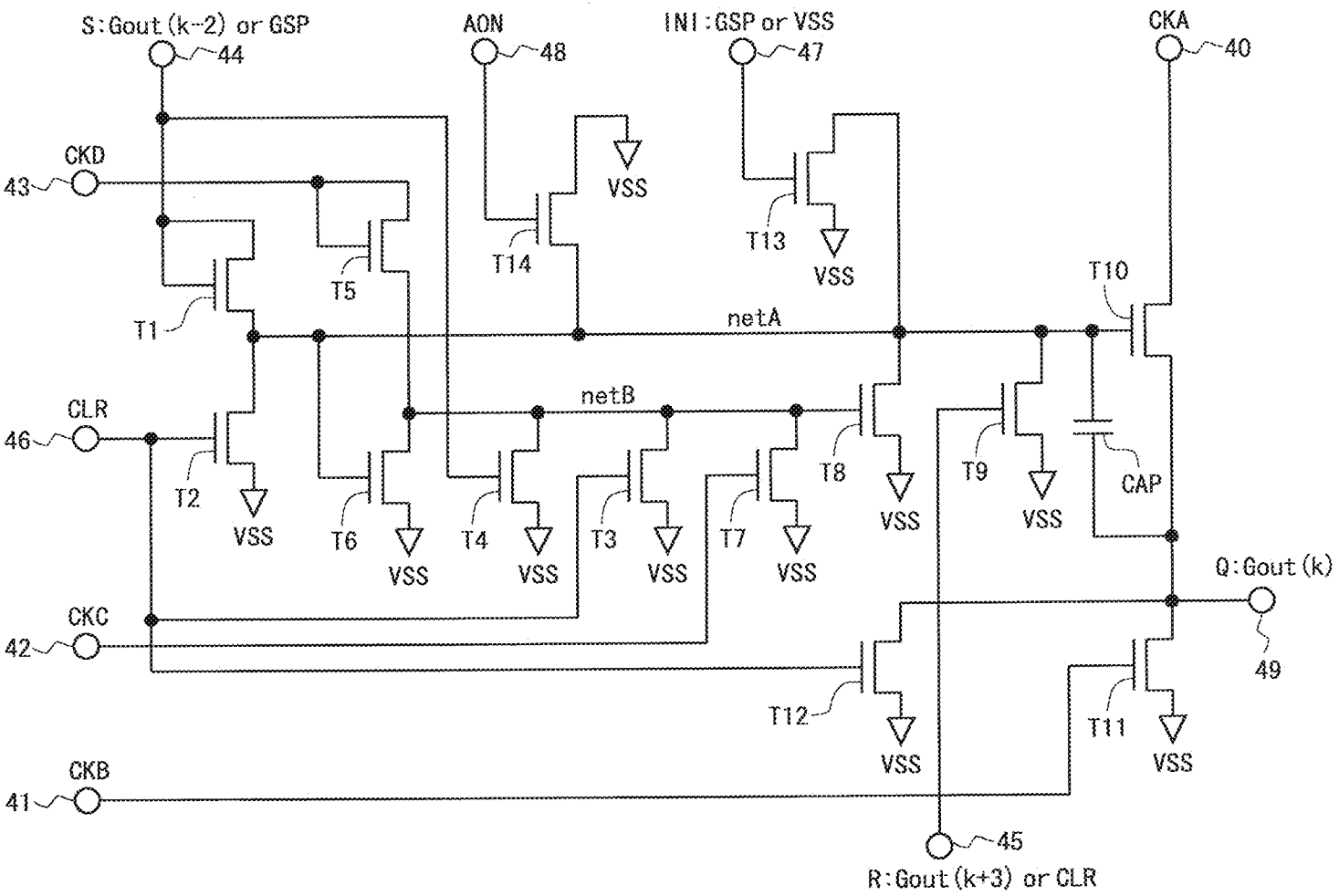
FIG. 18 is a circuit diagram showing a configuration of a unit circuit in the second embodiment.

FIG. 18 is a circuit diagram showing a configuration of a unit circuit 4 (which is assumed to be the k-th stage) in the present embodiment. The unit circuit 4 includes a thin-film transistor T14 and an input terminal 48 for receiving the off control signal AON, in addition to the components provided in the first embodiment. The thin-film transistor T14 is connected at its gate terminal to the input terminal 48, connected at its drain terminal to the reference voltage wiring line, and connected at its source terminal to the output control node netA. An off control transistor is implemented by the thin-film transistor T14.

Figure 19:
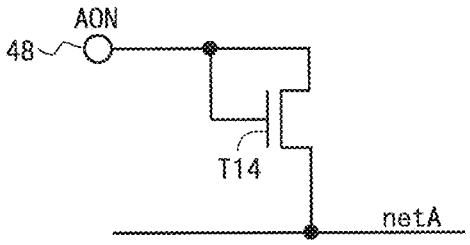
FIG. 19 is a diagram for describing another exemplary configuration of a thin-film transistor 114 shown in FIG. 18 in the second embodiment.

Note that the thin-film transistor T14 can also adopt a diode-connected configuration as shown in FIG. 19. In this case, the thin-film transistor T14 is connected at its gate and drain terminals to the input terminal 48 and connected at its source terminal to the output control node netA.

<2.2 Operation Performed when Supply of Power has Stopped>

Next, operation performed when supply of power has stopped will be described. Note that since the off control signal AON is maintained at a low level at normal times, operation performed at normal times is the same as that of the first embodiment. When supply of power stops, the power-off detecting unit 112 informs the level shifter circuit 13 that supply of power has stopped, by a power supply state signal SHUT. By this, the level shifter circuit 13 sets the voltage of the off control signal AON to the gate-on voltage VGH, in addition to the same settings as those of the first embodiment (see FIG. 20).

By setting the voltage of the gate start pulse signal GSP, the voltages of the gate clock signals GCK, and the reference voltage VSS to the gate-on voltage VGH, the output signal Q from each unit circuit 4 goes to a high level in the same manner as in the first embodiment. That is, all scanning lines GL(1) to GL(n) go into a selected state. At this time, a black voltage is applied to all data lines SL(1) to SL(m). As a result, charge accumulated in the pixel capacitance CP in each pixel formation portion is discharged.

Meanwhile, in the present embodiment, by setting the off control signal AON and the reference voltage VSS to the gate-on voltage VGH, the thin-film transistor T14 goes into an on state. Then, charge is supplied to the output control node netA through the thin-film transistor T14. That is, in the present embodiment, charge is supplied to the output control node netA through the thin-film transistor T13 and the thin-film transistor T14. Therefore, when supply of power has stopped, the thin-film transistor T10 is maintained in an on state for a longer period than a conventional one. Hence, in each unit circuit 4, the voltage of the output signal Q (the voltage at the output terminal 49) securely decreases with a decrease in the voltage of the gate clock signal GCK (first clock CKA) which is provided to the input terminal 40. Therefore, the voltage of the scanning signal Gout reaches the voltage of the ground GND within a desired period after supply of power stops. In this manner, charge on each scanning line GL is discharged.

<2.3 Examination by Simulation>

Figure 21:
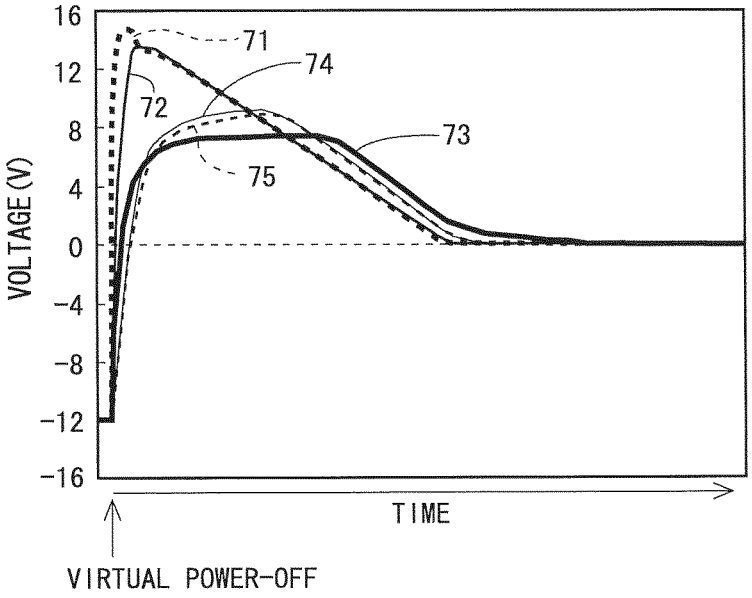
FIG. 21 is a waveform diagram for describing changes in the voltage waveforms of scanning signals for the simulation results shown in FIG. 12.

Next, simulation results about operation performed upon power-off will be described. In the first embodiment (i.e., a configuration in which the thin-film transistor T14 is not provided in the unit circuit 4), after the stop of supply of power, the voltage of the scanning signal Gout changes as indicated by the waveform given reference character 56 in FIG. 12. That is, the voltage of the scanning signal Gout reaches the voltage of the ground GND after a lapse of a predetermined time from the power-off. However, as shown in FIG. 21, the waveform of the scanning signal Gout varies from row to row. Note that in FIG. 21 the voltage waveforms of scanning signals Gout(1) to Gout(5) to be provided to scanning lines GL(1) to GL(5) of the first to fifth rows are given reference characters 71 to 75, respectively. As such, in the first embodiment, the behavior of the unit circuit 4 may vary from stage to stage.

Figure 22:
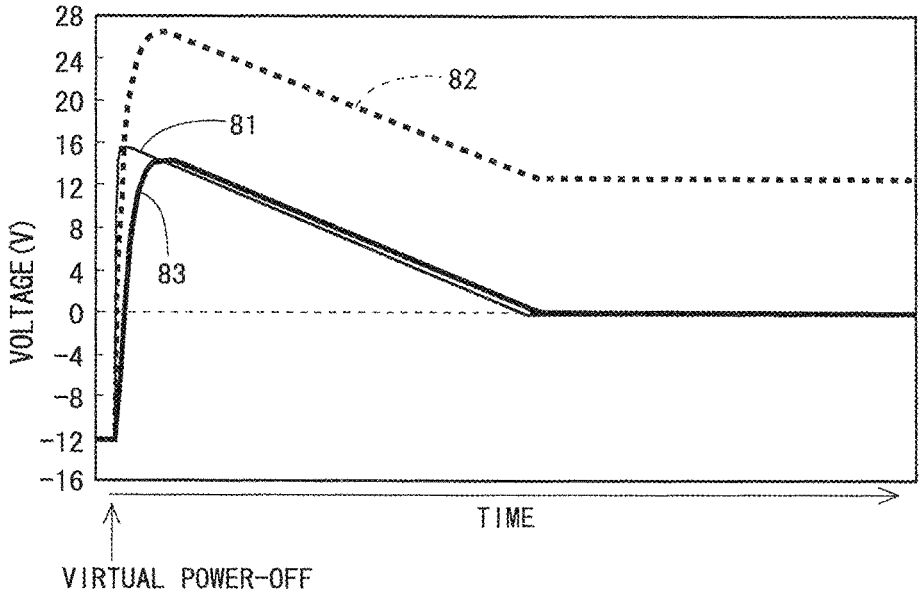
FIG. 22 is a diagram showing simulation results obtained when the thin-film transistor 114 having the configuration shown in FIG. 19 is used in the second embodiment.
Figure 23:
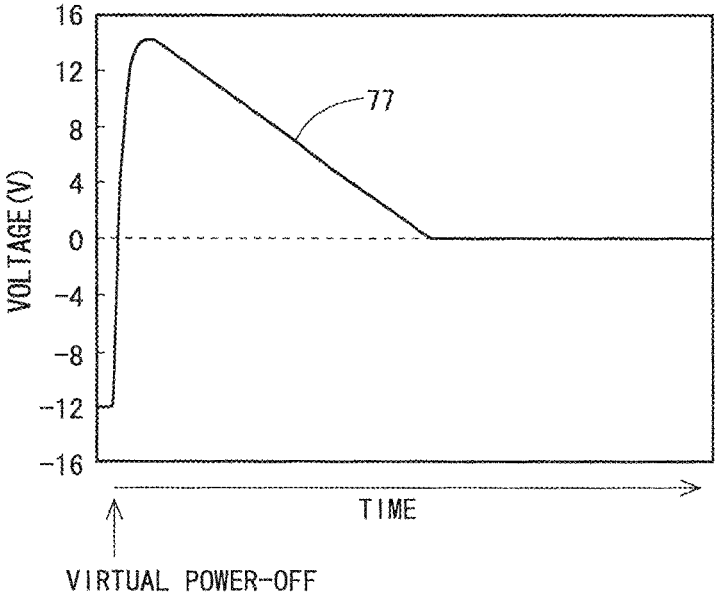
FIG. 23 is a waveform diagram for describing changes in the voltage waveform of a scanning signal for the simulation results shown in FIG. 22.

FIG. 22 is a diagram showing simulation results in a case in which the thin-film transistor 114 having the configuration shown in FIG. 19 is used, regarding the present embodiment. Note that in FIG. 22 a voltage waveform of the gate clock signal GCK, a voltage waveform of the output control node netA, and a voltage waveform of the scanning signal Gout are given reference characters 81, 82, and 83, respectively. As can be grasped from FIG. 22, the voltage of the scanning signal Gout reaches the voltage of the ground GND after a lapse of a predetermined time from power-off. In addition, for all rows, the scanning signal Gout has a voltage waveform given reference character 77 in FIG. 23. That is, in all rows, the voltage waveform of the scanning signal Gout changes in the same manner.

Figure 24:
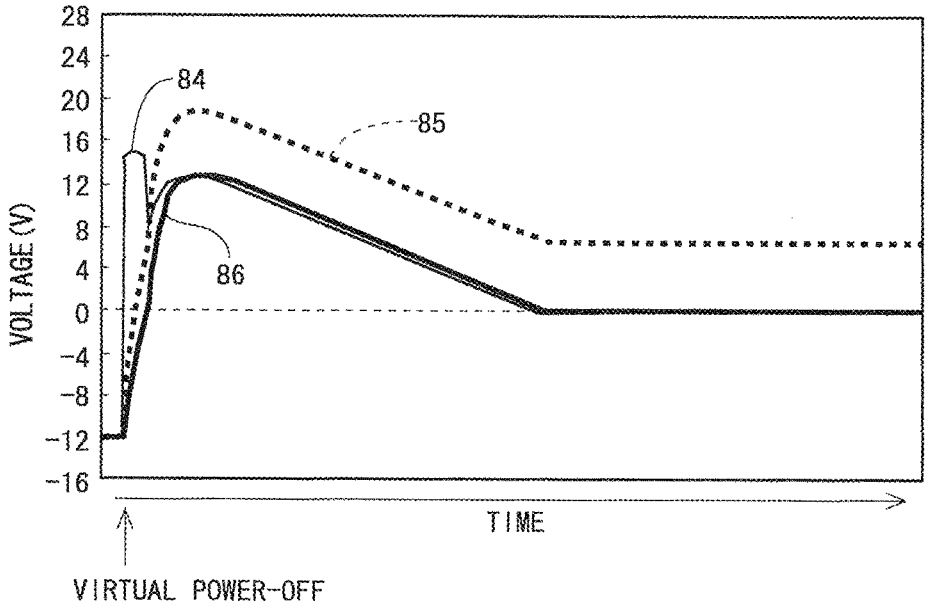
FIG. 24 is a diagram showing simulation results obtained when the thin-film transistor 114 having the configuration shown in FIG. 18 is used in the second embodiment.
Figure 25:
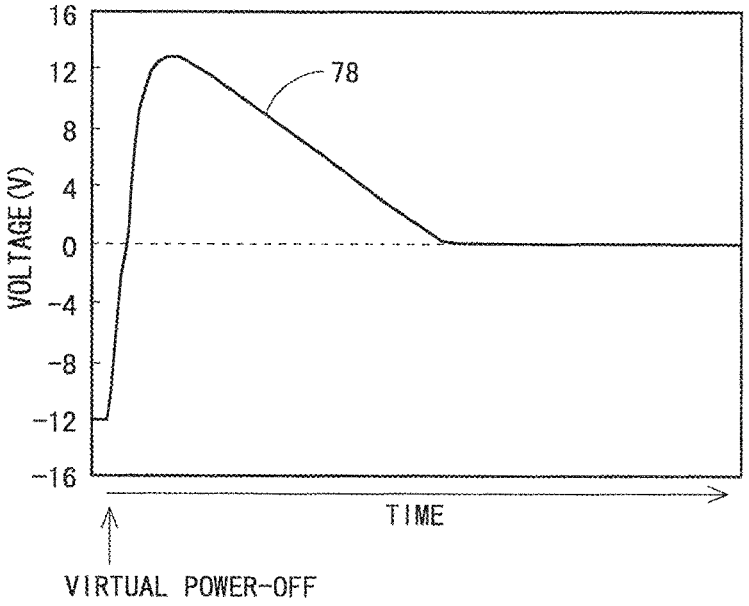
FIG. 25 is a waveform diagram for describing changes in the voltage waveform of a scanning signal for the simulation results shown in FIG. 24.
Figure 26:
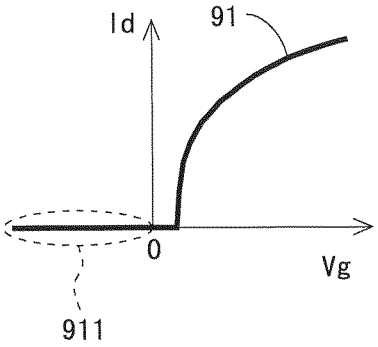
FIG. 26 is a diagram showing a Vg-Id characteristic of an IGZO-TFT.

FIG. 24 is a diagram showing simulation results in a case in which the thin-film transistor 114 having the configuration shown in FIG. 18 is used, regarding the present embodiment. Note that in FIG. 24 a voltage waveform of the gate clock signal GCK, a voltage waveform of the output control node netA, and a voltage waveform of the scanning signal Gout are given reference characters 84, 85, and 86, respectively. As can be grasped from FIG. 24, the voltage of the scanning signal Gout reaches the voltage of the ground GND after a lapse of a predetermined time from power-off. In addition, for all rows, the scanning signal Gout has a voltage waveform given reference character 78 in FIG. 25. That is, in all rows, the voltage waveform of the scanning signal Gout changes in the same manner.

From the above description, the configuration of the first embodiment is the simplest configuration because the thin-film transistor T14 and the wiring line for the off control signal AON are not required. Note, however, that there is a need to enhance charging capability by increasing the size of the thin-film transistor T13 so that the output control node netA can be sufficiently and promptly charged after the stop of supply of power, and there is a need to consider the fact that the behavior of the unit circuit 4 varies from stage to stage. According to the present embodiment, although the number of components required increases compared to the first embodiment, since the unit circuits 4 of all stages behave in the same manner, designing becomes easy. In addition, regarding the present embodiment, the voltage at the output control node netA is maintained at a higher level after the stop of supply of power in a case in which the thin-film transistor T14 having the configuration shown in FIG. 19 is adopted than in a case in which the thin-film transistor T14 having the configuration shown in FIG. 18 is adopted. Therefore, when the thin-film transistor T14 having the configuration shown in FIG. 19 is adopted, although residual charge at the output control node netA becomes large, charge on the scanning line GL is more securely discharged. Taking into account the above-described points, a configuration to be actually adopted may be determined.

<2.3 Effects>

As in the first embodiment, also in the present embodiment, it becomes possible for a liquid crystal display device that adopts IGZO-TFTs which are TFTs with excellent off characteristics to suppress the occurrence of display failure caused by residual charge, with a simple configuration.

In addition, according to the present embodiment, in each unit circuit 4 included in the shift register 240 in the gate driver 24, there is provided the thin-film transistor T14 connected at its source terminal to the output control node netA. When supply of power from the external source stops, charge is supplied to the output control node netA through the thin-film transistor T13 and the thin-film transistor T14. Hence, the thin-film transistor T10 is maintained in an on state for a longer period than a conventional one. By this, in each unit circuit 4, the voltage at the output terminal 49 securely decreases with a decrease in the voltage at the input terminal 40. That is, the voltage of the scanning signal Gout securely decreases with a decrease in the voltage of the gate clock signal GCK. As a result, the occurrence of display failure caused by residual charge on the scanning lines GL is effectively suppressed.

Meanwhile, the off control signal AON is transmitted from the level shifter circuit 13 to the unit circuits 4 in the gate driver 24 through the dedicated wiring line. Therefore, a load on the wiring line is very small. On the other hand, the reference voltage wiring line that transmits the reference voltage VSS is, as can be grasped from FIG. 18, connected to many thin-film transistors in the unit circuit 4, and thus, a load on the reference voltage wiring line is large. From this fact, the thin-film transistor T14 goes into an on state more promptly in a configuration in which the drain terminal of the thin-film transistor T14 is connected to the wiring line for the off control signal AON than in a configuration in which the drain terminal of the thin-film transistor T14 is connected to the reference voltage wiring line. That is, by adopting the thin-film transistor T14 having the configuration shown in FIG. 19, it becomes possible to more rapidly charge the output control node netA upon power-off. By this, it becomes possible to more securely suppress the occurrence of display failure caused by residual charge.

3. Others

Although the present invention has been described in detail above, the above description is to be considered in all respects as illustrative and not restrictive. It is to be understood that many other changes and modifications can be devised without departing from the spirit and scope of the present invention.

For example, although the above-described embodiments describe an example in which n-channel TFTs are used, p-channel TFTs can also be used. In addition, specific configurations of the shift register 240 and the unit circuits 4 are also not limited to those shown in the above-described embodiments.

What is claimed is:

1. A display device comprising:

a display panel including a plurality of scanning lines each connected to a plurality of pixel formation portions, and a scanning line drive circuit configured to selectively drive the plurality of scanning lines;

a voltage generator circuit configured to receive supply of power from an external source, and generate one type of scanning line selection voltage and one type of scanning line non-selection voltage, the scanning line selection voltage being a voltage for bringing the scanning lines into a selected state, and the scanning line non-selection voltage being a voltage for bringing the scanning lines into a non-selected state; and a drive control circuit configured to control operation of the scanning line drive circuit, using the scanning line selection voltage and the scanning line non-selection voltage generated by the voltage generator circuit, wherein the scanning line drive circuit includes a shift register configured to perform shift operation based on a plurality of clock signals, the shift register including a plurality of unit circuits provided so as to have one-to-one correspondence with the plurality of scanning lines, each unit circuit includes:

an output node connected to a corresponding scanning line;

an output control transistor having a control terminal, a first conduction terminal to which one of the plurality of clock signals is provided, and a second conduction terminal connected to the output node;

an output control node connected to the control terminal of the output control transistor; and a reset transistor having a control terminal to which a clear signal for initializing internal states of the plurality of unit circuits is provided; a first conduction terminal connected to the output control node; and a second conduction terminal to which a reference voltage is provided, the reference voltage being outputted from the drive control circuit and serving as a reference for operation of the scanning line drive circuit, the drive control circuit:

sets a voltage of each of the plurality of clock signals to the scanning line selection voltage and the scanning line non-selection voltage alternately and sets the reference voltage to the scanning line non-selection voltage, at normal times;

sets the voltage of each of the plurality of clock signals and the reference voltage to the scanning line selection voltage and sets a voltage of the clear signal to less than or equal to a voltage of ground without setting the voltage of the clear signal to the scanning line selection voltage, when the supply of power stops, each unit circuit includes an off control transistor having a control terminal, a first conduction terminal, and a second conduction terminal connected to the output control node, and the drive control circuit:

sets a voltage provided to the control terminal of the off control transistor and a voltage provided to the first conduction terminal of the off control transistor to the scanning line non-selection voltage at normal times; and sets the voltage provided to the control terminal of the off control transistor and the voltage provided to the first conduction terminal of the off control transistor to the scanning line selection voltage when the supply of power stops.

2. The display device according to claim 1, wherein an off control signal outputted from the drive control circuit is provided to the control terminal of the off control transistor through a dedicated wiring line.

3. The display device according to claim 2, wherein the off control signal is provided to the first conduction terminal of the off control transistor.

4. The display device according to claim 2, wherein the reference voltage is provided to the first conduction terminal of the off control transistor.

5. A display device comprising:

a display panel including a plurality of scanning lines each connected to a plurality of pixel formation portions, and a scanning line drive circuit configured to selectively drive the plurality of scanning lines;

a voltage generator circuit configured to receive supply of power from an external source, and generate one type of scanning line selection voltage and one type of scanning line non-selection voltage, the scanning line selection voltage being a voltage for bringing the scanning lines into a selected state, and the scanning line non-selection voltage being a voltage for bringing the scanning lines into a non-selected state; and a drive control circuit configured to control operation of the scanning line drive circuit, using the scanning line selection voltage and the scanning line non-selection voltage generated by the voltage generator circuit, wherein the scanning line drive circuit includes a shift register configured to perform shift operation based on a plurality of clock signals, the shift register including a plurality of unit circuits provided so as to have one-to-one correspondence with the plurality of scanning lines, each unit circuit includes:

an output node connected to a corresponding scanning line;

an output control transistor having a control terminal, a first conduction terminal to which one of the plurality of clock signals is provided, and a second conduction terminal connected to the output node;

an output control node connected to the control terminal of the output control transistor; and a reset transistor having a control terminal to which a clear signal for initializing internal states of the plurality of unit circuits is provided; a first conduction terminal connected to the output control node; and a second conduction terminal to which a reference voltage is provided, the reference voltage being outputted from the drive control circuit and serving as a reference for operation of the scanning line drive circuit, the drive control circuit:

sets a voltage of each of the plurality of clock signals to the scanning line selection voltage and the scanning line non-selection voltage alternately and sets the reference voltage to the scanning line non-selection voltage, at normal times; and sets the voltage of each of the plurality of clock signals and the reference voltage to the scanning line selection voltage and sets a voltage of the clear signal to less than or equal to a voltage of ground, when the supply of power stops, the display panel includes a plurality of transistors including the output control transistor and the reset transistor, and at least some of the plurality of transistors are transistors whose off-leakage current is 1/10 or less than off-leakage current of a thin-film transistor whose channel layer is formed of low-temperature polysilicon.

6. The display device according to claim 5, wherein at least some of the plurality of transistors are thin-film transistors whose channel layers are formed of indium gallium zinc oxide.

7. A display device comprising:

a display panel including a plurality of scanning lines each connected to a plurality of pixel formation portions, and a scanning line drive circuit configured to selectively drive the plurality of scanning lines;

a voltage generator circuit configured to receive supply of power from an external source, and generate one type of scanning line selection voltage and one type of scanning line non-selection voltage, the scanning line selection voltage being a voltage for bringing the scanning lines into a selected state, and the scanning line non-selection voltage being a voltage for bringing the scanning lines into a non-selected state; and a drive control circuit configured to control operation of the scanning line drive circuit, using the scanning line selection voltage and the scanning line non-selection voltage generated by the voltage generator circuit, wherein the scanning line drive circuit includes a shift register configured to perform shift operation based on a plurality of clock signals, the shift register including a plurality of unit circuits provided so as to have one-to-one correspondence with the plurality of scanning lines, each unit circuit includes:

an output node connected to a corresponding scanning line;

an output control transistor having a control terminal, a first conduction terminal to which one of the plurality of clock signals is provided, and a second conduction terminal connected to the output node;

an output control node connected to the control terminal of the output control transistor; and a reset transistor having a control terminal to which a clear signal for initializing internal states of the plurality of unit circuits is provided; a first conduction terminal connected to the output control node; and a second conduction terminal to which a reference voltage is provided, the reference voltage being outputted from the drive control circuit and serving as a reference for operation of the scanning line drive circuit, the drive control circuit:

sets a voltage of each of the plurality of clock signals to the scanning line selection voltage and the scanning line non-selection voltage alternately and sets the reference voltage to the scanning line non-selection voltage, at normal times; and sets the voltage of each of the plurality of clock signals and the reference voltage to the scanning line selection voltage and sets a voltage of the clear signal to less than or equal to a voltage of ground, when the supply of power stops, each unit circuit includes an off control transistor having a control terminal, a first conduction terminal, and a second conduction terminal connected to the output control node, and the drive control circuit:

sets a voltage provided to the control terminal of the off control transistor and a voltage provided to the first conduction terminal of the off control transistor to the scanning line non-selection voltage at normal times; and sets the voltage provided to the control terminal of the off control transistor and the voltage provided to the first conduction terminal of the off control transistor to the scanning line selection voltage when the supply of power stops.

8. The display device according to claim 7, wherein an off control signal outputted from the drive control circuit is provided to the control terminal of the off control transistor through a dedicated wiring line.

9. The display device according to claim 7, wherein the off control signal is provided to the first conduction terminal of the off control transistor.

10. The display device according to claim 7, wherein the reference voltage is provided to the first conduction terminal of the off control transistor.

* * * * *